US007847784B2

(12) United States Patent
Yasunaga

(10) Patent No.: US 7,847,784 B2
(45) Date of Patent: Dec. 7, 2010

(54) METHOD FOR DRIVING LIQUID CRYSTAL DISPLAY ASSEMBLY

(75) Inventor: Hiroaki Yasunaga, Tokyo (JP)

(73) Assignee: Sony Corporation, Tokyo (JP)

( * ) Notice: Subject to any disclaimer, the term of this patent is extended or adjusted under 35 U.S.C. 154(b) by 884 days.

(21) Appl. No.: 11/786,786

(22) Filed: Apr. 12, 2007

(65) Prior Publication Data

US 2007/0247415 A1 Oct. 25, 2007

(30) Foreign Application Priority Data

Apr. 19, 2006 (JP) ..... 2006-115822

(51) Int. Cl.
*G09G 3/36* (2006.01)

(52) U.S. Cl. ..... 345/102; 345/89; 345/82; 345/76; 345/690; 349/69

(58) Field of Classification Search ..... 345/102, 345/88–89, 690, 692, 207, 204, 208–210; 315/169.3; 349/61–69
See application file for complete search history.

(56) References Cited

U.S. PATENT DOCUMENTS

| | | | | |
|---|---|---|---|---|
| 2001/0038371 | A1* | 11/2001 | Yoshinaga et al. | 345/87 |
| 2002/0003522 | A1* | 1/2002 | Baba et al. | 345/89 |
| 2002/0036608 | A1* | 3/2002 | Hirakata et al. | 345/87 |
| 2006/0146007 | A1* | 7/2006 | Lim et al. | 345/102 |
| 2007/0222743 | A1* | 9/2007 | Hirakata | 345/102 |

FOREIGN PATENT DOCUMENTS

| | | |
|---|---|---|
| JP | 11-109317 | 4/1999 |
| JP | 2001-175216 A | 6/2001 |
| JP | 2001-236034 A | 8/2001 |
| JP | 2001-332394 A | 11/2001 |
| JP | 2002-099250 A | 4/2002 |
| JP | 2003-149626 A | 5/2003 |
| JP | 2003-255914 A | 9/2003 |
| JP | 2005-017324 | 1/2005 |
| JP | 2005-241678 A | 9/2005 |

* cited by examiner

*Primary Examiner*—Lun-Yi Lao
(74) *Attorney, Agent, or Firm*—Wolf, Greenfield & Sacks, P.C.

(57) ABSTRACT

A method driving an LCD assembly, the LCD assembly including a transmission-type LCD including a display area configured of pixels, a planar-light-source device illuminating the display area, and a driving circuit driving the planar-light-source device and LCD; wherein the driving circuit supplies a control signal controlling the optical transmittance of each pixel to each pixel, the method comprising, for each frame with LCD image display, the steps of: controlling the luminance of the planar-light-source device by the driving circuit such that, when assuming that the control signal equivalent to a driving signal having the maximum value of driving signals input to the driving circuit driving all the pixels making up the display area is supplied to a pixel, the luminance of the pixel is obtained; and controlling the luminance of the planar-light-source device by the driving circuit based on the response speed of a liquid-crystal material making up the pixels.

11 Claims, 16 Drawing Sheets

METHOD FOR DRIVING LIQUID CRYSTAL DISPLAY ASSEMBLY

CROSS REFERENCES TO RELATED APPLICATIONS

The present invention contains subject matter related to Japanese Patent Application JP 2006-115822 filed in the Japanese Patent Office on Apr. 19, 2006, the entire contents of which are incorporated herein by reference.

BACKGROUND OF THE INVENTION

1. Field of the Invention

The present invention relates to a method for driving a liquid crystal display assembly.

2. Description of the Related Art

With a liquid crystal display device, a liquid crystal material itself does not emit light. Accordingly, for example, a direct planar light source device (backlight) for illuminating a display area of a liquid crystal display is disposed at the back of the display area. Note that with a color liquid crystal display, one pixel is made up of three sub pixels of a red light emitting sub pixel, a green light emitting sub pixel, and a blue light emitting sub pixel. Liquid crystal cells making up each pixel or each sub pixel are operated as a sort of light shutter (light valve), i.e., the optical transmittance of each pixel or each sub pixel is controlled, thereby controlling the optical transmittance of illumination light (e.g., white light) emitted from a planar light source device, and displaying an image.

An existing planar light source device in a liquid crystal display assembly illuminates the entire display area with even and constant brightness. This state is schematically illustrated in (A) in FIG. 12 and (A) in FIG. 13 as the luminance of the planar light source device (sometimes referred to as light source luminance). Controlling the optical transmittance of pixels A and B (see (B) in FIG. 12 and (B) in FIG. 13) enables the luminance (sometimes referred to as display luminance) of a part of a display area corresponding to the pixels A and B to be controlled (see (C) in FIG. 12 and (C) in FIG. 13). Now, let us say that the pixel A is located at the upper portion of the liquid crystal display, and the pixel B is located at the lower portion of the liquid crystal display.

Note that later-described (A) in FIG. 14(A) and (A) in FIG. 15(A) are diagrams schematically illustrating light source luminance, (B) and (C) in FIG. 14 schematically illustrate the optical transmittance and display luminance of the pixel A, and (B) and (C) in FIG. 15 schematically illustrate the optical transmittance and display luminance of the pixel B. The horizontal axes of FIG. 12 through FIG. 15 illustrate the time course (number of frames) of image display.

Also, a planar light source device having another configuration different from such a planar light source device, i.e., a planar light source device, which are configured of multiple planar light source units, for changing a distribution of illuminance at multiple display area units making up a color liquid crystal display has been known from Japanese Unexamined Patent Application Publication No. 2005-17324. Note that such a planar light source device made up of multiple planar light source units are sometimes referred to as a time-sharing-driven planar light source device for the sake of convenience.

Further, controlling a planar light source device based on a later-described method has been disclosed in Japanese Unexamined Patent Application Publication No. 11-109317, for example. Specifically, let us say that the maximum luminance in the planar light source device is taken as $Y_{max}$, and the maximum value (specifically, 100% for example) of the optical transmittance (aperture ratio) of a pixel at a display area is taken as $Lt_{max}$. Also, let us say that when the planar light source device has the maximum luminance $Y_{max}$, the optical transmittance (aperture ratio) of the pixel for obtaining display luminance $y_0$ in the display area is taken as $Lt_0$. In this case, the light source luminance $Y_0$ of the planar light source device needs to be controlled so as to satisfy $$Y_0 \cdot Lt_{max} = Y_{max} \cdot Lt_0$$

Note that a conceptual diagram regarding such control is illustrated in (A) and (B) in FIG. 16. Here, the light source luminance $Y_0$ is changed for each frame.

Specifically, for example, in the event that the light source luminance ($Y_0$) is controlled such as schematically illustrated in (A) in FIG. 14 and (A) in FIG. 15, and additionally, the optical transmittance Lt of a pixel is controlled such as schematically illustrated with the solid lines in (B) in FIG. 14 and (B) in FIG. 15, the display luminance (y) at the pixels A and B such as schematically illustrated with the solid lines in (C) in FIG. 14 and (C) in FIG. 15 can be obtained.

SUMMARY OF THE INVENTION

Incidentally, liquid crystal material has a limited response speed. Therefore, the optical transmittance Lt of a pixel actually changes such as illustrated with a dotted line in (B) in FIG. 15. On the other hand, in the event that the light source in the planar light source device is configured of a light emitting diode (LED), change in the luminance of the light source is quicker than change in the optical transmittance of a pixel, as shown in (A) in FIG. 15. Accordingly, in the event that the values of the driving signals externally input to the liquid crystal display assembly to drive a pixel are constant, the display luminance such as illustrated with a solid line in (C) in FIG. 15 ought to be obtained, but actually, only the display luminance such as illustrated with a dotted line in (C) in FIG. 15 is obtained. Subsequently, in the event that such change in display luminance occurs, this can be recognized as flickering on a display image of the liquid crystal display.

Therefore, it is desirable for the present invention to provide a method for driving a liquid crystal display assembly which prevents a display image of the liquid crystal display from flickering.

According to a first arrangement of the present invention, there is provided a method for driving a liquid crystal display assembly, the liquid crystal display assembly including a transmission-type liquid crystal display including a display area made up of pixels arrayed in a two-dimensional matrix form, a planar light source device illuminating the display area from the back, and a driving circuit for driving the planar light source device and the liquid crystal display; wherein a control signal for controlling the optical transmittance of each of the pixels is supplied to each of the pixels from the driving circuit; the method comprising, for each frame with image display of the liquid crystal display, the steps of: controlling the luminance of the planar light source device by the driving circuit such that, when assuming that the control signal equivalent to a driving signal having a value equivalent to an intra-frame driving signal maximum value $X_{F\text{-}max}$ which is the maximum value of the values of driving signals that are input to the driving circuit for driving all of the pixels making up the display area is supplied to a pixel, the luminance of the pixel is obtained; and controlling the luminance of the planar light source device by the driving circuit based on the response speed of a liquid crystal material making up the pixels.

According to a second arrangement of the present invention, there is provided a method for driving a liquid crystal display assembly, the liquid crystal display assembly including a transmission-type liquid crystal display including a display area made up of pixels arrayed in a two-dimensional matrix form, which is subjected to line sequential driving, a planar light source device which is made up of, when assuming that the display area of the liquid crystal display are divided into P×Q virtual display area units, P×Q planar light source units corresponding to the P×Q display area units, with each of the planar light source units illuminating the display area unit corresponding thereto from the back, and a driving circuit for driving the planar light source device and the liquid crystal display; wherein a control signal for controlling the optical transmittance of each of the pixels is supplied to each of the pixels from the driving circuit, the method comprising, for each frame with image display of the liquid crystal display, the steps of: controlling the luminance of the planar light source unit by the driving circuit such that, when assuming that the control signal equivalent to a driving signal having a value equivalent to an intra-frame driving signal maximum value $X_{F\text{-}max}$ which is the maximum value of the values of driving signals that are input to the driving circuit for driving all of the pixels making up the display area is supplied to a pixel, the luminance of the pixel is obtained; controlling the luminance of the planar light source unit by the driving circuit based on the response speed of a liquid crystal material making up the pixels; and controlling the light emitting start period of each of the planar light source units by the driving circuit depending on the disposed position of each of the planar light source units.

According to a third arrangement of the present invention, there is provided a method for driving a liquid crystal display assembly, the liquid crystal display assembly including a transmission-type liquid crystal display including a display area made up of pixels arrayed in a two-dimensional matrix form, which is subjected to line sequential driving, a planar light source device which is made up of, when assuming that the display area of the liquid crystal display are divided into P×Q virtual display area units, P×Q planar light source units corresponding to the P×Q display area units, with each of the planar light source units illuminating the display area unit corresponding thereto from the back, and a driving circuit for driving the planar light source device and the liquid crystal display; wherein a control signal for controlling the optical transmittance of each of the pixels is supplied to each of the pixels from the driving circuit; the method comprising, for each frame with image display of the liquid crystal display, the steps of: controlling the luminance of the planar light source unit corresponding to the display unit by the driving circuit with each of the planar light source units such that, when assuming that the control signal equivalent to a driving signal having a value equivalent to an intra-display-area-unit driving signal maximum value $X_{U\text{-}max}$ which is the maximum value of the values of driving signals that are input to the driving circuit for driving all of the pixels making up the display area is supplied to a pixel, the luminance of the pixel is obtained; and controlling the luminance of the planar light source unit by the driving circuit based on the response speed of a liquid crystal material making up the pixels.

The method for driving a liquid crystal display assembly according to the third arrangement of the present invention for each frame with image display of said liquid crystal display, further including the step of: controlling the light emitting start period of each of the planar light source units by the driving circuit depending on the disposed position of each of the planar light source units.

With the methods for driving a liquid crystal display assembly according to the first through third arrangements of the present invention, an arrangement can be made wherein each of the pixels is configured with multiple sub pixels as a set each of which emits light having a different color, and the control signal for controlling the optical transmittance of each of the sub pixels is supplied from the driving circuit to each of the sub pixels making up each of the pixels. That is to say, the liquid crystal display in this case is a color liquid crystal display. Also, in this case, specifically, each pixel is configured with three sub pixels of a red light emitting sub pixel, a green light emitting sub pixel, and a blue light emitting sub pixel as a set, or alternatively is configured with one or multiple sub pixels being added to these three sub pixels as a set (e.g., a set to which a sub pixel for emitting white light to improve luminance is added, a set to which a sub pixel for emitting a complementary color to enlarge a color reproduction range is added, a set to which a sub pixel for emitting yellow to enlarge a color reproduction range is added, or a set to which a sub pixel for emitting yellow and cyan to enlarge a color reproduction range is added).

With the methods for driving a liquid crystal display assembly according to the first through third arrangements of the present invention including the above preferable embodiments, a light source making up the planar light source or planar light source unit is made up of a light emitting diode driven based on pulse-width modulation (PWM), and when assuming that the number of the unit luminescence periods of the light emitting diode in one frame is K, an arrangement is preferably made wherein a duty ratio in driving based on the pulse-width modulation of the light emitting diode during the k'th unit luminescence period (wherein, k=1, 2, 3, and so on through K) is controlled, thereby controlling the luminance of the planar light source unit based on the response speed of the liquid crystal material making up the pixels. However, the present invention is not restricted to such a configuration, and as for a light source making up the planar light source or planar light source unit, the other, e.g., light source applying a cold-cathode-line fluorescent lamp or electroluminescence (EL) can be employed.

Note that with an preferable embodiment such as the method for driving a liquid crystal display assembly according to the second arrangement of the present invention, or the method for driving a liquid crystal display assembly according to the third arrangement of the present invention, the light emitting start period of each planar light source unit is controlled by the driving circuit depending on the disposed position of each planar light source unit, but in this case, with the relation between the value of Q and the value of K in the P×Q (Q rows, P lines) planar light source units, the value of K is preferably set to an integral multiple of the value of Q, i.e., when assuming that α is a positive integer constant, satisfying $$K=\alpha\times Q$$

is preferable from the respective of handiness of light emitting control in the planar light source units. Or, alternatively, with the driving circuit, the light emitting start period of each planar light source unit may be delayed depending on the disposed position of each planar light source unit. Here, an arrangement may be made wherein delay time is determined with the value of Q as a parameter beforehand, and is stored in a storage device included in the driving circuit. More specifically, the transmission-type liquid crystal display subjected to line sequence driving includes a scan electrode (extending in a first direction) and a data electrode (extending in a second direction) which cross in a matrix form, a scan signal is input to the scan electrode to select and scan the scan electrode, an image is displayed based on the data signal input to the data electrode, thereby making up one screen, but during one frame the light emitting start period of each planar light source unit corresponding to the display area unit including the scan electrode, which is selected by a scan signal being input more slowly, needs to be further delayed. However, the light emitting period of the respective planar light source units is the same.

Now, the optical transmittance (also referred to as aperture ratio) Lt of a pixel or sub pixel, the luminance (display luminance) y of a part of a display area corresponding to a pixel or sub pixel, and the luminance (light source luminance) Y of the planar light source device or planar light source unit are defined as follows.

$Y_1$ is of light source luminance, e.g., the maximum luminance, and is sometimes referred to as a light source luminance first stipulated value below. $Lt_1$ is of the optical transmittance (aperture ratio) of a pixel or sub pixel in the display area or display area unit, e.g., the maximum value, and is sometimes referred to as an optical transmittance first stipulated value below. $Lt_2$ is, when assuming that a control signal equivalent to a driving signal having the same value as the intra-frame driving signal maximum $x_{F\text{-}max}$ or the intra-display-area-unit driving signal maximum value $x_{U\text{-}max}$ is supplied to a pixel or sub pixel at the time the light source luminance being the light source luminance first stipulated value $Y_1$, the optical transmittance (aperture ratio) of the pixel or sub pixel, and is sometimes referred to as an optical transmittance second stipulated value below. Note that $0 \leqq Lt_2 \leqq Lt_1 y_2$ is the display luminance obtained by assuming that the light source luminance is the light source first stipulated value $Y_1$, and the optical transmittance (aperture ratio) of a pixel or sub pixel is the optical transmittance second stipulated value $Lt_2$, and is sometimes referred to as a display luminance second stipulated value below. $Y_2$ is the light source luminance of the planar light source device or planar light source unit for setting the luminance of the pixel or sub pixel to the display luminance second stipulated value ($y_2$) when assuming that a control signal equivalent to a driving signal having the same value as the intra-frame driving signal maximum $x_{F\text{-}max}$ or the intra-display-area-unit driving signal maximum value $x_{U\text{-}max}$ is supplied to a pixel or sub pixel, and also when assuming that the optical transmittance (aperture ratio) of the pixel or sub pixel is the optical transmittance first stipulated value $Lt_1$.

With the methods for driving a liquid crystal display assembly according to the first through third arrangements of the present invention including the above preferable embodiments (hereafter, sometimes generically simply referred to as the present invention), the luminance of the planar light source device is controlled by the driving circuit so as to obtain the luminance of the pixel (the display luminance second stipulated value $y_2$ at the optical transmittance first stipulated value $Lt_1$) when assuming that a control signal equivalent to a driving signal having the same value as the intra-frame driving signal maximum $x_{F\text{-}max}$ or the intra-display-area-unit driving signal maximum value $x_{U\text{-}max}$ is supplied to a pixel, and specifically, for example, when the optical transmittance (aperture ratio) of a pixel or sub pixel is taken as the optical transmittance first stipulated value $Lt_1$ for example, the light source luminance $Y_2$ needs to be controlled (e.g., needs to be decreased) so as to obtain the display luminance $Y_2$. That is to say, for example, the light source luminance $Y_2$ needs to be controlled for each frame so as to satisfy the following Expression (1). Note that the relation $Y_2 \leqq Y_1$ holds.

$$Y_2 \cdot Lt_1 = Y_1 \cdot Lt_2 \tag{1}$$

With the present invention, in the event that a light source is configured with a red light emitting diode, a green light emitting diode, and a blue light emitting diode as a set to obtain white light, the red light emitting diode emits light in red with a wavelength of 640 nm for example, the green light emitting diode emits light in green with a wavelength of 530 nm for example, and the blue light emitting diode emits light in blue with a wavelength of 450 nm for example. Note that light emitting diodes for emitting light in the fourth color, fifth color, and so on other than red, green, and blue may be further provided. Or, alternatively, an arrangement may be made wherein a white light emitting diode (e.g., light emitting diode for emitting light in white by combining infrared or blue light emitting diode and a fluorescent substance particle) is provided.

With the methods for driving a liquid crystal display assembly according to the first and second arrangements of the present invention, the luminance of the planar light source device or planar light source unit is controlled by the driving circuit so as to obtain the luminance of the pixel (the display luminance second stipulated value $y_2$ at the optical transmittance first stipulated value $Lt_1$) when assuming that a control signal equivalent to a driving signal having the same value as the intra-frame driving signal maximum value $X_{F\text{-}max}$ is supplied to a pixel for each frame in the image display of the liquid crystal display, whereby reduction in the power consumption of the planar light source device can be realized. Also, with the method for driving a liquid crystal display assembly according to the third arrangement of the present invention, the luminance of the planar light source unit is controlled by the driving circuit so as to obtain the luminance of the pixel (the display luminance second stipulated value $y_2$ at the optical transmittance first stipulated value $Lt_1$) when assuming that a control signal equivalent to a driving signal having the same value as the intra-display-area-unit driving signal maximum value $X_{u\text{-}max}$ is supplied to a pixel for each frame in the image display of the liquid crystal display, whereby reduction in the power consumption of the planar light source device can be realized, and also the luminance (light intensity) of the planar light source unit corresponding to the display area unit is increased or decreased, whereby a high contrast ratio can be obtained.

Moreover, with the methods for driving a liquid crystal display assembly according to the first through third arrangements of the present invention, the luminance of the planar light source device or planar light source unit is controlled by the driving circuit based on the response speed of a liquid crystal material making up a pixel, so even in the event that the value of the driving signal to be input to the liquid crystal display assembly is constant, whereby flickering on the display image of the liquid crystal display can be prevented from occurring in a sure manner.

Further, with an preferable embodiment such as the method for driving a liquid crystal display assembly according to the second arrangement of the present invention, or the method for driving a liquid crystal display assembly according to the third arrangement of the present invention, the light emitting start period of each planar light source unit is controlled by the driving circuit depending on the disposed position of each planar light source unit, whereby much more exact and precise control of the display image of the liquid crystal display can be performed.

DESCRIPTION OF THE PREFERRED EMBODIMENTS

The present invention will be described below based on embodiments with reference to the drawings.

First Embodiment

The first embodiment relates to a method for driving a liquid crystal display assembly according to a first arrangement of the present invention. Note that with the first embodiment, and later-described second through fourth embodiments, let us say that a transmission-type liquid crystal display is a transmission-type color liquid crystal display.

Figure 5:
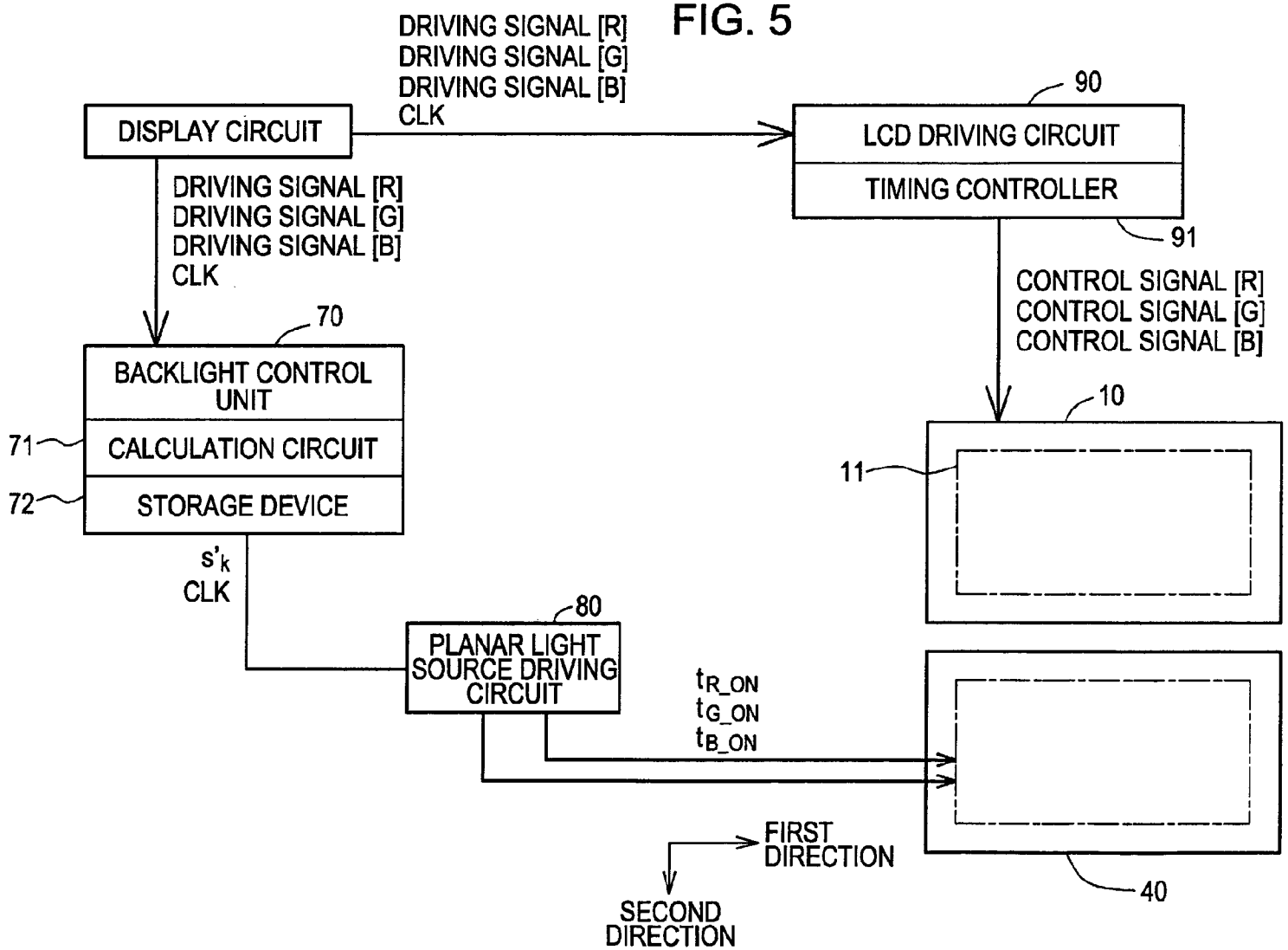
FIG. 5 is a conceptual diagram of a liquid crystal display assembly made up of a color liquid crystal display, a planar light source device, and a driving circuit which are suitable for the use in the first embodiment.

As shown in a conceptual diagram in FIG. 5, a transmission-type color liquid crystal display 10 according to the first embodiment includes a display area 11 wherein $M_0$ pixels in a first direction, and $N_0$ pixels in a second direction, and $M_0 \times N_0$ pixels in total are arrayed in a two-dimensional matrix form. Specifically, for example, with the image display resolution thereof satisfying HDTV Specifications, and representing the number of pixels $M_0 \times N_0$ arrayed in a two-dimensional form as ($M_0$, $N_0$), (1920, 1080) can obtained for example. Also, the display area 11 made up of pixels arrayed in a two-dimension matrix form is illustrated with a dashed dotted line in FIG. 5. Here, each pixel is configured with multiple sub pixels, each of which emits a different color, as a set. More specifically, each pixel is configured of three sub pixels of a red light emitting sub pixel (sub pixel[R]), a green light emitting sub pixel (sub pixel[G]), and a blue light emitting sub pixel (sub pixel[B]). This transmission-type color liquid crystal display 10 is subjected to line sequence driving. More specifically, the color liquid crystal display 10 includes a scan electrode (extending in a first direction) and a data electrode (extending in a second direction) which cross in a matrix form, a scan signal is input to the scan electrode to select and scan the scan electrode, an image is displayed based on the data signal (signal based on a control signal) input to the data electrode, thereby making up one screen. Note that a transmission-type color liquid crystal display 10A according to later-described second through fourth embodiments also has essentially the same constitution and configuration.

Figure 7:
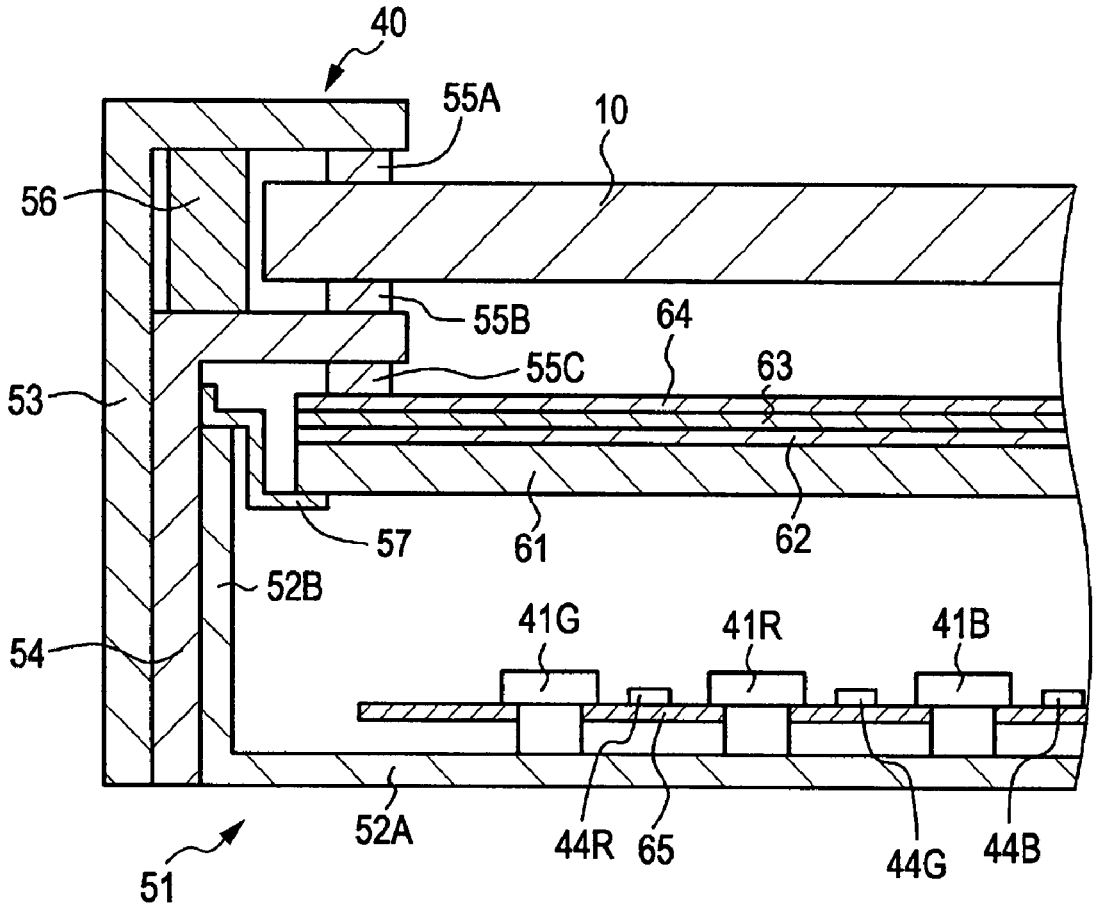
FIG. 7 is a partial cross-sectional view schematically illustrating the planar light source device and color liquid crystal display according to the first through third embodiments.

A direct planar light source device (backlight) 40 illuminates the display area 11 from the back. Note that the planar light source device 40 is located under the color liquid crystal display 10, but in FIG. 5, the color liquid crystal display 10 and the planar light source device 40 are illustrated separately. A schematic partial cross-sectional view of the planar light source device and the color liquid crystal display is illustrated in FIG. 7. Note that the light source making up the planar light source device 40 is made up of light emitting diodes 41 which are driven based on pulse-width modulation.

The planar light source device 40 is made up of a casing 51 including an outer frame 53 and an inner frame 54. The end portion of the transmission-type color liquid crystal display 10 is held so as to be sandwiched with the outer frame 53 and the inner frame 54 via spacers 55A and 55B. Also, a guide member 56 is disposed between the outer frame 53 and the inner frame 54, whereby the color liquid crystal display 10 sandwiched with the outer frame 53 and the inner frame 54 is configured so as not to shift. At the upper portion within the casing 51 a diffusion plate 61 is attached to the inner frame 54 via a spacer 55C and a bracket member 57. Also, an optical function sheet group such as a diffusion sheet 62, a prism sheet 63, and a polarization conversion sheet 64 are layered over the diffusion plate 61.

At the lower portion within the casing 51 a reflective sheet 65 is provided. Here, this reflective sheet 65 is disposed such that the reflective surface thereof faces the diffusion plane 61, and is attached to the bottom 52A of the casing 51 via an unshown attachment member. The reflective sheet 65 can be configured of a silver enhancement reflection film including a configuration wherein a silver reflection film, a low-refractive-index film, and a high-refractive-index film are layered on a sheet base material in order, for example. The reflective sheet 65 reflects light emitted from the multiple light emitting diodes 41, and light reflected at the side 52B of the casing 51. Thus, red light, green light, and blue light, which were emitted from multiple red light emitting diodes 41R for emitting red light, multiple green light emitting diodes 41G for emitting green light, and multiple blue light emitting diodes 41B for emitting blue light, are mixed, and white light with high color purity can be obtained as illumination light. This illumination light passes through the optical function sheet group such as the diffusion plate 61, diffusion sheet 62, prism sheet 63, and polarization conversion sheet 64, and illuminates the color liquid crystal display 10 from the back. Photodiodes 44R, 44G, and 44B are disposed near the bottom 52A of the casing 51. Note that the photodiode 44R is a photodiode to which a red filter is attached for measuring the light intensity of red light, the photodiode 44G is a photodiode to which a green filter is attached for measuring the light intensity of green light, and the photodiode 44B is a photodiode to which a blue filter is attached for measuring the light intensity of blue light.

As for the array state of the light emitting diodes 41R, 41G, and 41B, for example, multiple light emitting diode units each made up of the red light emitting diode 41R for emitting red light (e.g., wavelength of 640 nm), the green light emitting diode 41G for emitting green light (e.g., wavelength of 530 nm), and the blue light emitting diode 41B for emitting blue light (e.g., wavelength of 450 nm) as a set can be arrayed in the horizontal direction and in the vertical direction.

The driving circuit for driving the planar light source device 40 and the color liquid crystal display 10 is configured of a backlight control unit 70 for performing on/off control of the red light emitting diode 41R, green light emitting diode 41G, and blue light emitting diode 41B, which make up the planar light source device 40, based on the pulse-width modulation method, a planar light source driving circuit 80, and a liquid crystal display driving circuit 90. Here, the backlight control unit 70 is made up of a calculation circuit 71, and a storage device (memory) 72. On the other hand, the planar light source driving circuit 80 is made up of a calculation circuit 81, a storage device (memory) 82, an LED driving circuit 83, a photodiode control circuit 84, switching devices 85R, 85G, and 85B which are made up of an FET, and a light emitting diode driving power source (constant current source) 86. The light emitting states of the light emitting diodes 41R, 41G, and 41B at a certain frame are measured by the photodiodes 44R, 44G, and 44B, the output from the photodiodes 44R, 44G, and 44B is input to the photodiode control circuit 84, and is converted into data (signal) serving as the luminance and chromaticity of the light emitting diodes 41R, 41G, and 41B at the photodiode control circuit 84 and the calculation circuit 81, this data is conveyed to the LED driving circuit 83, and then the light emitting states of the light emitting diodes 41R, 41G, and 41B at the next frame are controlled, whereby a feedback mechanism is formed. Here in FIG. 6, only the one light emitting diode driving power source (constant current source) 86 is illustrated, but actually the light emitting driving power sources 86 for driving the respective light emitting diodes 41R, 41G, and 41B are disposed. Known circuits may be employed for these circuits making up the backlight control unit 70 and the planar light source driving circuit 80. On the other hand, the liquid crystal display driving circuit 90 for driving the color liquid crystal display 10 is made up of a known circuit such as a timing controller 91. Also, the color liquid crystal display 10 is provided with a gate driver, a source driver, and the like (these are not shown) for driving a switching device (not shown) made up of a TFT making up a liquid crystal cell.

Note that the planar light source device 40 and the driving circuits 70, 80A, and 90 according to later-described second through fourth embodiments also have basically the same constitutions and configurations as the planar light source device 40 and the driving circuits 70, 80, and 90 according to the first embodiment.

Now, hereinafter a red light emitting sub-pixel (sub pixel [R]), green light emitting sub-pixel (sub pixel[G]), and blue light emitting sub-pixel (sub pixel[B]) may be collectively referred to as "sub pixels R, G, B", the red light emitting control signal, green light emitting control signal, and blue light emitting control signal as "control signal R, G, B", and the red light emitting sub-pixel driving signal, green light emitting sub-pixel driving signal, and blue light emitting sub-pixel driving signal as "driving signal R, G, B".

Each pixel is configured with three sub pixels of a sub pixel[R] (red light emitting sub pixel), a sub pixel[G] (green light emitting sub pixel), and a sub pixel[B] (blue light emitting sub pixel) as a set. With the descriptions of the following embodiments, let us say that control (gradation control) of the luminance of each of the sub pixels R, G, B is 8-bit control, i.e., is performed with $2^8$ steps of 0 through 255. Accordingly, values $x_R$, $x_G$, and $x_B$ of the driving signal R, G, B that are input to the liquid crystal display driving circuit 90 each take the values of $2^8$ steps to drive each of the sub pixels R, G, B of each pixel making up the display area 11. Also, values $S_R$, $S_G$, and $S_B$ of pulse-width modulation output signals for controlling the light emitting time of each of the red light emitting diode 41R, green light emitting diode 41G, and blue light emitting diode 41B, making up the planar light source device 40, each take the values of $2^8$ steps of 0 through 255 as well. However, the values are not restricted to these, for example, as 10-bit control $2^{10}$ steps of 0 through 1023 can be employed, and in this case, the expression with the numerical value of 8 bits needs to be quadrupled, for example.

With the following description, let us say that $S_R=S_G=S_B=S_0$ holds, for the sake of convenience.

A control signal for controlling the optical transmittance Lt of each pixel is supplied to each pixel from the driving circuit. Specifically, the control signals R, G, B for controlling the optical transmittance Lt of each of the sub pixels R, G, B are supplied to each of the sub pixels R, G, B from the liquid crystal display driving circuit 90. That is to say, with the liquid crystal display driving circuit 90, the control signals R, G, B are generated from the input driving signals R, G, B, and these control signals R, G, B are supplied to the sub pixels R, G, B. Note that the light source luminance $Y_2$ in the planar light source device 40 is changed for each frame, so the control signals R, G, B include the values wherein the values obtained by the values of the driving signals R, G, B to the 2.2 'th power being subjected to correction (compensation) based on the variations of the light source luminance $Y_2$. Subsequently, the control signals R, G, B are sent to the gate driver and source driver of the color liquid crystal display 10 from the timing controller 91 making up the liquid crystal display driving circuit 90 using a known method, the switching device (not shown) making up each sub pixel is driven based on the control signals R, G, B, and a desired voltage is applied to a transparent first electrode and a transparent second electrode (these are not shown) making up a liquid crystal cell, whereby the optical transmittance (aperture ratio) Lt of each sub pixel is controlled. Here, the greater the values of the control signals R, G, B are, the higher the optical transmittance (aperture ratio of sub pixels) Lt of the sub pixels R, G, B are, and also the higher the value of the luminance (display luminance y) of the sub pixels R, G, B are. In other words, an image (normally, one type, and punctiform) made up of light passing through the sub pixels R, G, B is bright.

Control of the display luminance y and the light source luminance $Y_2$ is performed for each frame in the image display of the color liquid crystal display 10. Also, the operation of the color liquid crystal display 10 and the operation of the planar light source device 40 are synchronized within one frame or over two consecutive frames.

With the first embodiment, for each frame in the image display of the liquid crystal display (a) the luminance (light source luminance $Y_2$) of the planar light source device 40 is controlled by the driving circuits 70 and 80 so as to obtain the luminance (the display luminance second stipulated value $y_2$ at the optical transmittance first stipulated value $Lt_1$) of the pixel when assuming that a control signal equivalent to a driving signal having the same value as the intra-frame driving signal maximum value $x_{F\text{-}max}$ which is the maximum value of the values of the driving signals input to the driving circuits 70, 80, and 90 for driving all the pixels making up the display area 11 is supplied to a pixel, and also (b) the luminance (light source luminance $Y_2$) of the planar light source device 40 is controlled by the driving circuits 70 and 80 based on the response speed of a liquid crystal material making up a pixel.

Figure 1:
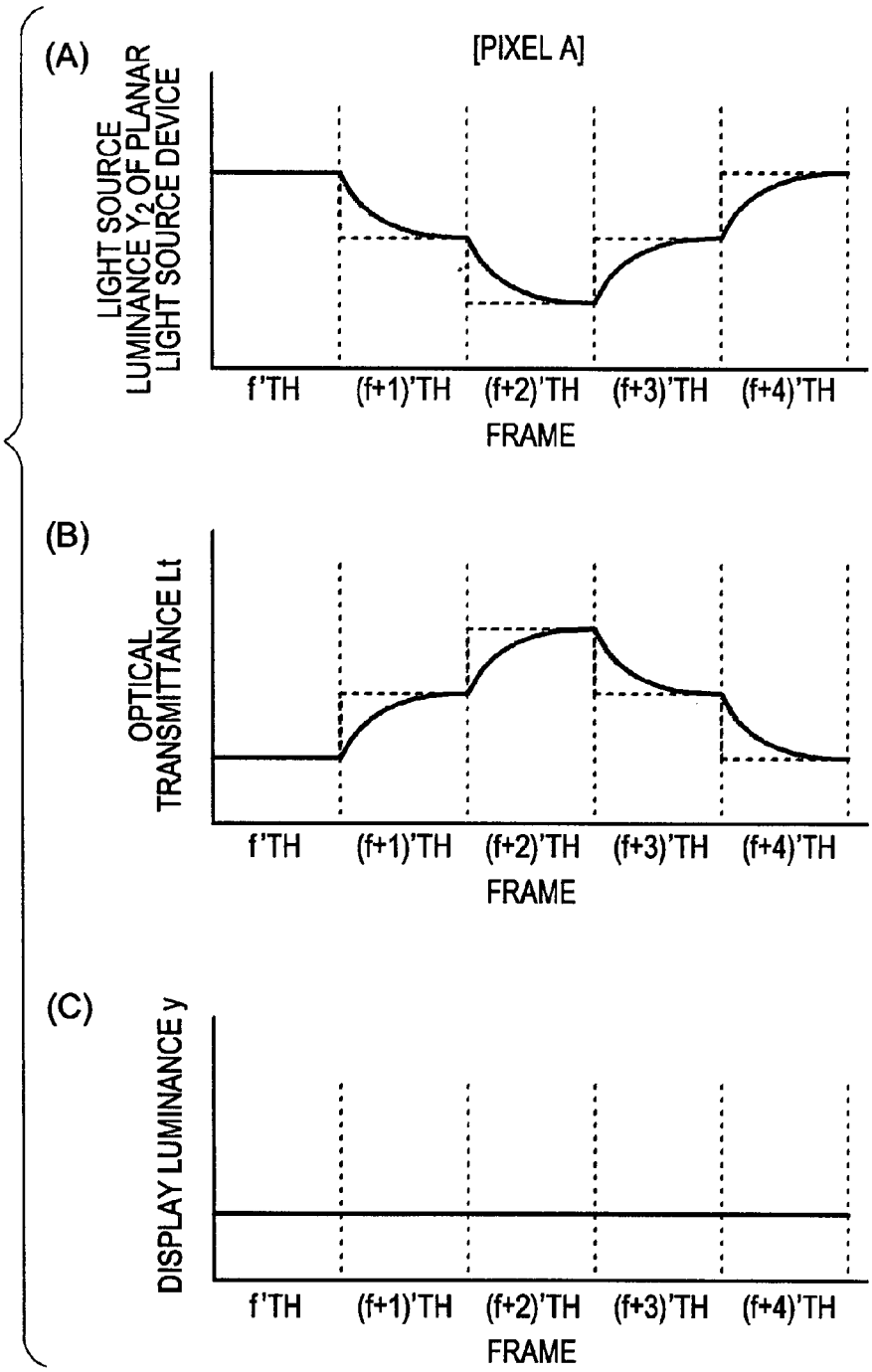
FIG. 1 is a diagram schematically illustrating the luminance of a planar light source device (light source luminance $Y_2$), and the optical transmittance Lt and luminance (display luminance y) regarding a certain pixel (sub pixel) with a method for driving a liquid crystal display assembly according to a first embodiment.
Figure 2:
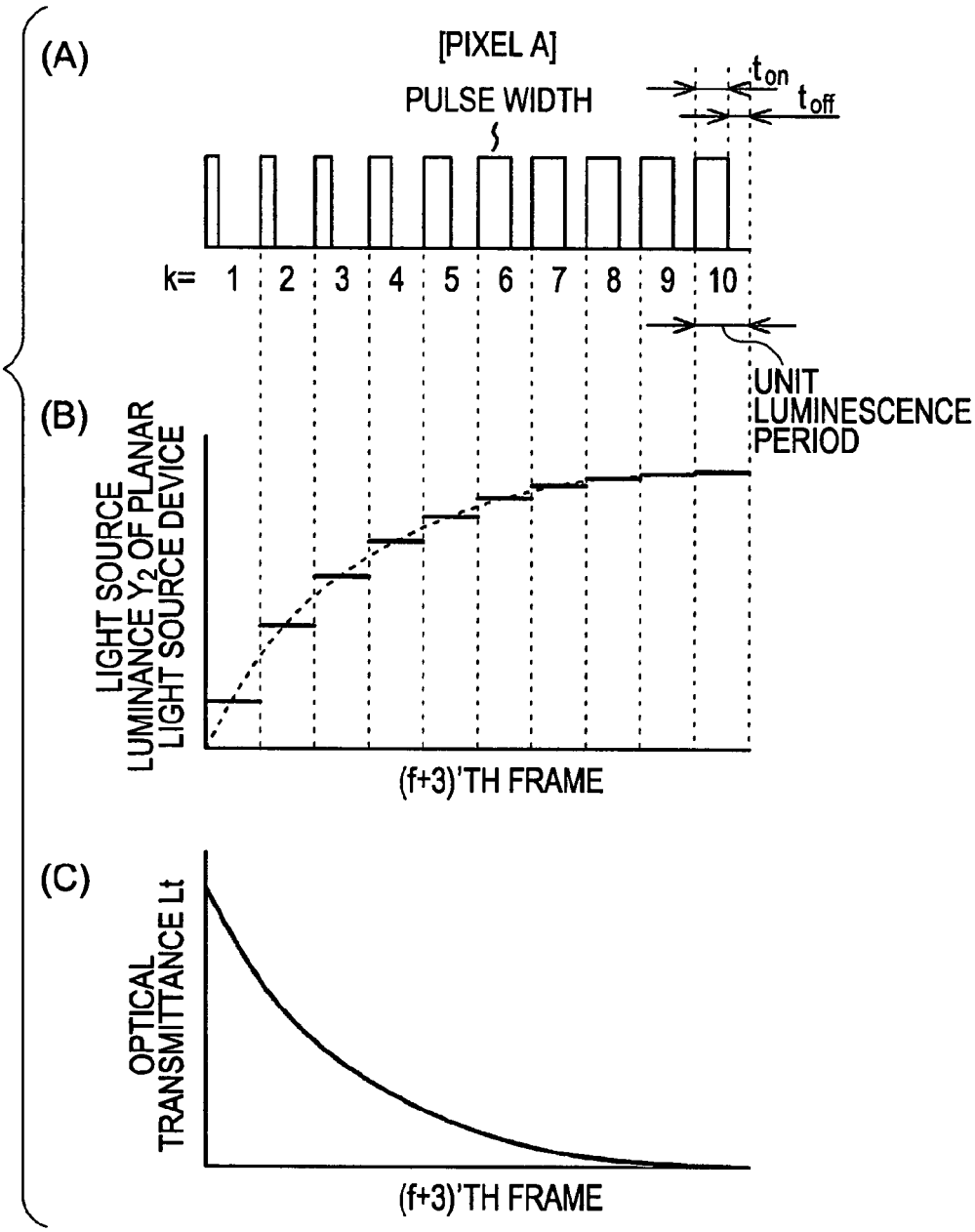
FIG. 2 is a diagram schematically illustrating control of a duty ratio, the luminance of the planar light source device (light source luminance $Y_2$), and the optical transmittance Lt of a pixel with driving based on the pulse-width modulation of a light emitting diode according to one frame with the method for driving a liquid crystal display assembly according to the first embodiment.
Figure 3:
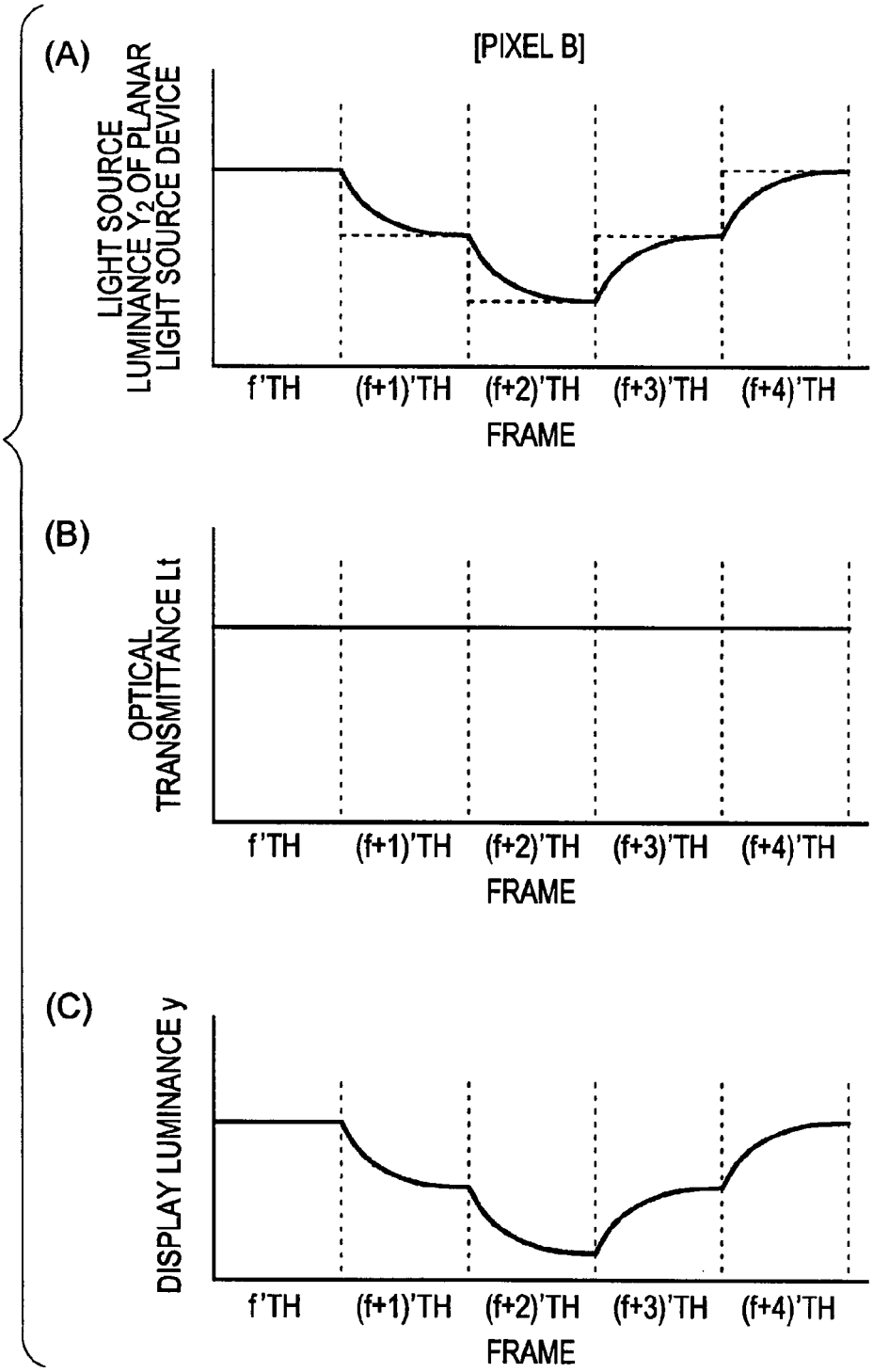
FIG. 3 is a diagram schematically illustrating the luminance of the planar light source device (light source luminance $Y_2$), and the optical transmittance Lt and luminance (display luminance y) regarding a pixel (sub pixel) that is different from the pixel shown in FIG. 1 with the method for driving a liquid crystal display assembly according to the first embodiment.

With regard to a certain pixel (sub pixel) with the method for driving the liquid crystal display assembly according to the first embodiment, the luminance (light source luminance $Y_2$) of the planar light source device, and the optical transmittance Lt and luminance (display luminance y) of the pixel are schematically illustrated in FIGS. 1 and 3. Note that FIG. 1 relates to a pixel A, and FIG. 3 relates to a pixel B. Here, the pixel A is located at the upper portion of the color liquid crystal display 10A, and the pixel B is located at the lower portion of the color liquid crystal display 10, and the pixel B, which is selected by a scan signal being input more slowly as compared with the pixel A, within one frame. Note that the horizontal axes in FIGS. 1 and 3 represent the time course (number of frames) of image display. Also, with the method for driving the liquid crystal display assembly according to the first embodiment, control of the duty ratio in driving based on the pulse-width modulation of the light emitting diode in one frame (the (f+3)'th frame in (B) in FIG. 1) (hereafter, sometimes simply referred to as duty ratio), the luminance (light source luminance $Y_2$) of the planar light source device, and the optical transmittance Lt of a pixel are schematically illustrated in FIG. 2.

Figure 15:
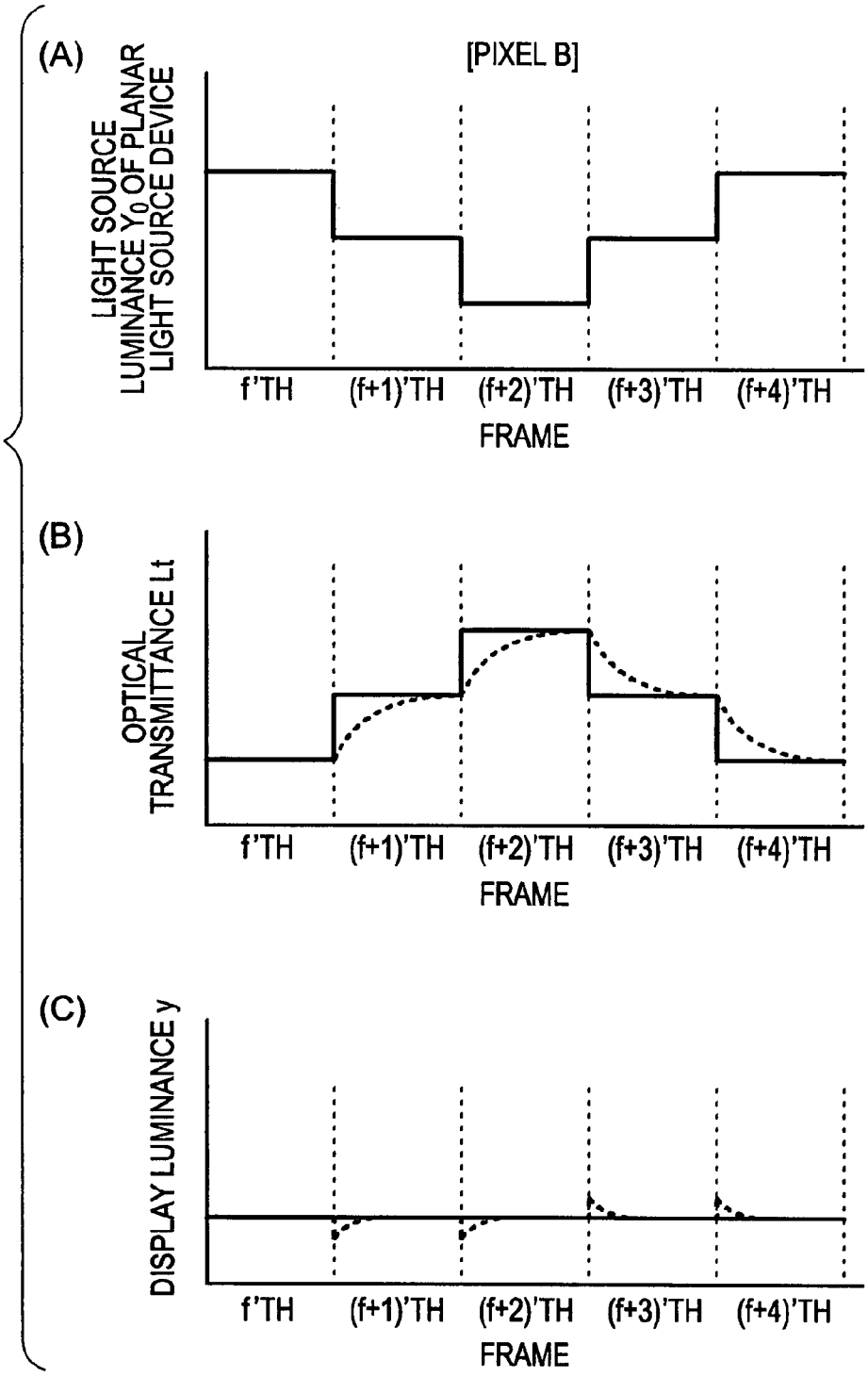
FIG. 15 is a diagram schematically illustrating the luminance of the planar light source device (light source luminance), the optical transmittance of the pixel B, and the change of luminance (display luminance) for each frame with the pixel B when assuming that the luminance of the planar light source device (light source luminance) is variable in an existing technique.
Figure 16:
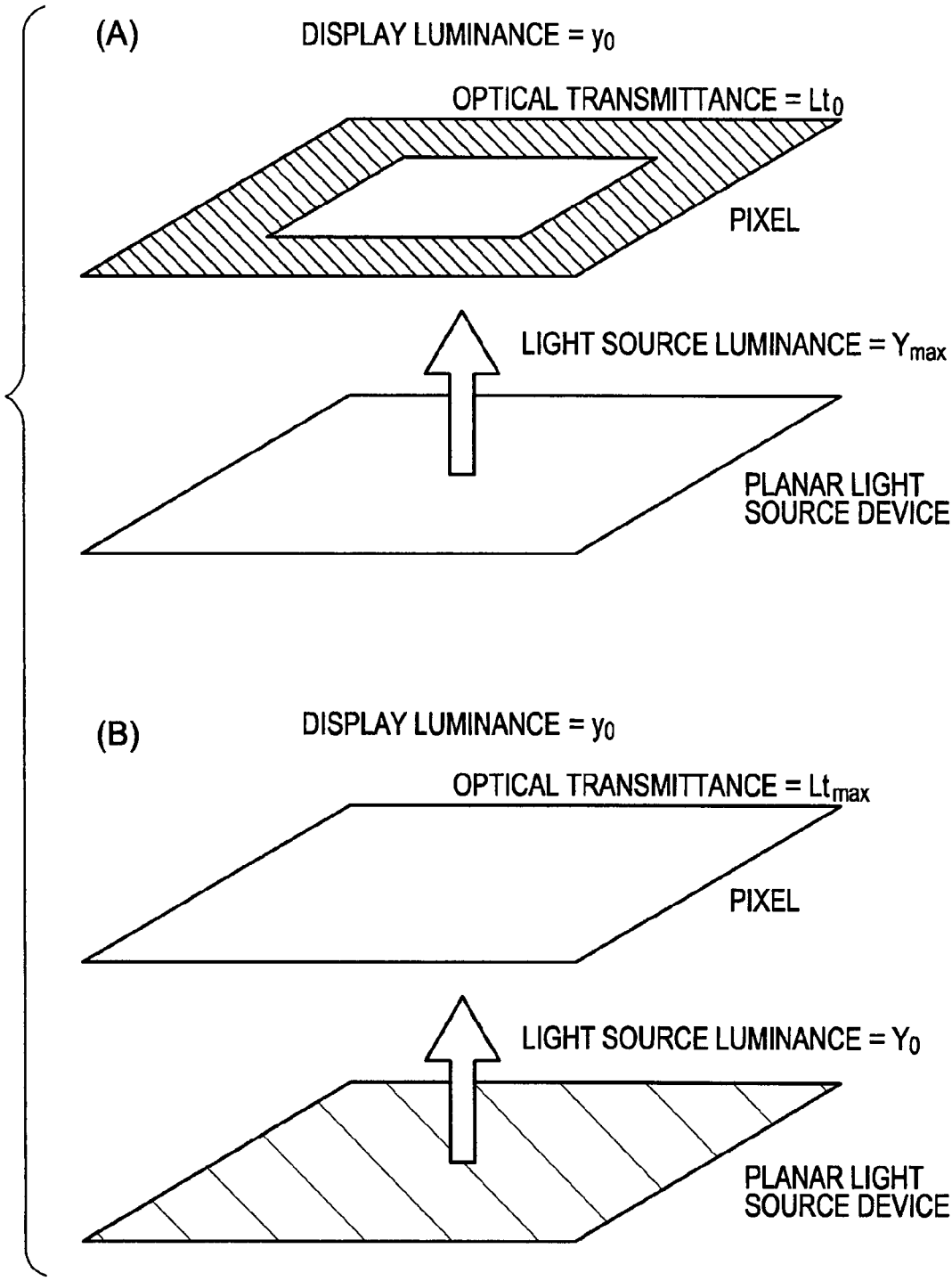
FIG. 16 is a conceptual diagram for describing the relation between the light source luminance of the planar light source device, the optical transmittance (aperture ratio) of a pixel, and the display luminance of a display area in an existing technique.

As described above, a liquid crystal material has a limited response speed. Therefore, the optical transmittance Lt of a pixel is changed such as shown with solid lines in (B) in FIG. 1, (C) in FIG. 2, and (B) in FIG. 3. With the method for driving the liquid crystal display assembly according to the first embodiment, as shown in (A) in FIG. 1 and (A) in FIG. 3, the light source luminance $Y_2$ of the planar light source device 40 is controlled by the driving circuits 70 and 80 based on the response speed of the liquid crystal material making up a pixel. Accordingly, even in the event that the value of the driving signal externally input to the liquid crystal display assembly for driving a pixel is constant, the display luminance y such as shown with a solid line in (C) in FIG. 1, which is different from the existing technique shown in FIG. 15, can be obtained. Consequently, no flickering occurs on the display image of the color liquid crystal display 10. Also, the display luminance y such as shown with a solid line in (C) in FIG. 3 is obtained, but even such display luminance y does not provide uncomfortable feeling to those who view the color liquid crystal display 10.

Figure 4:
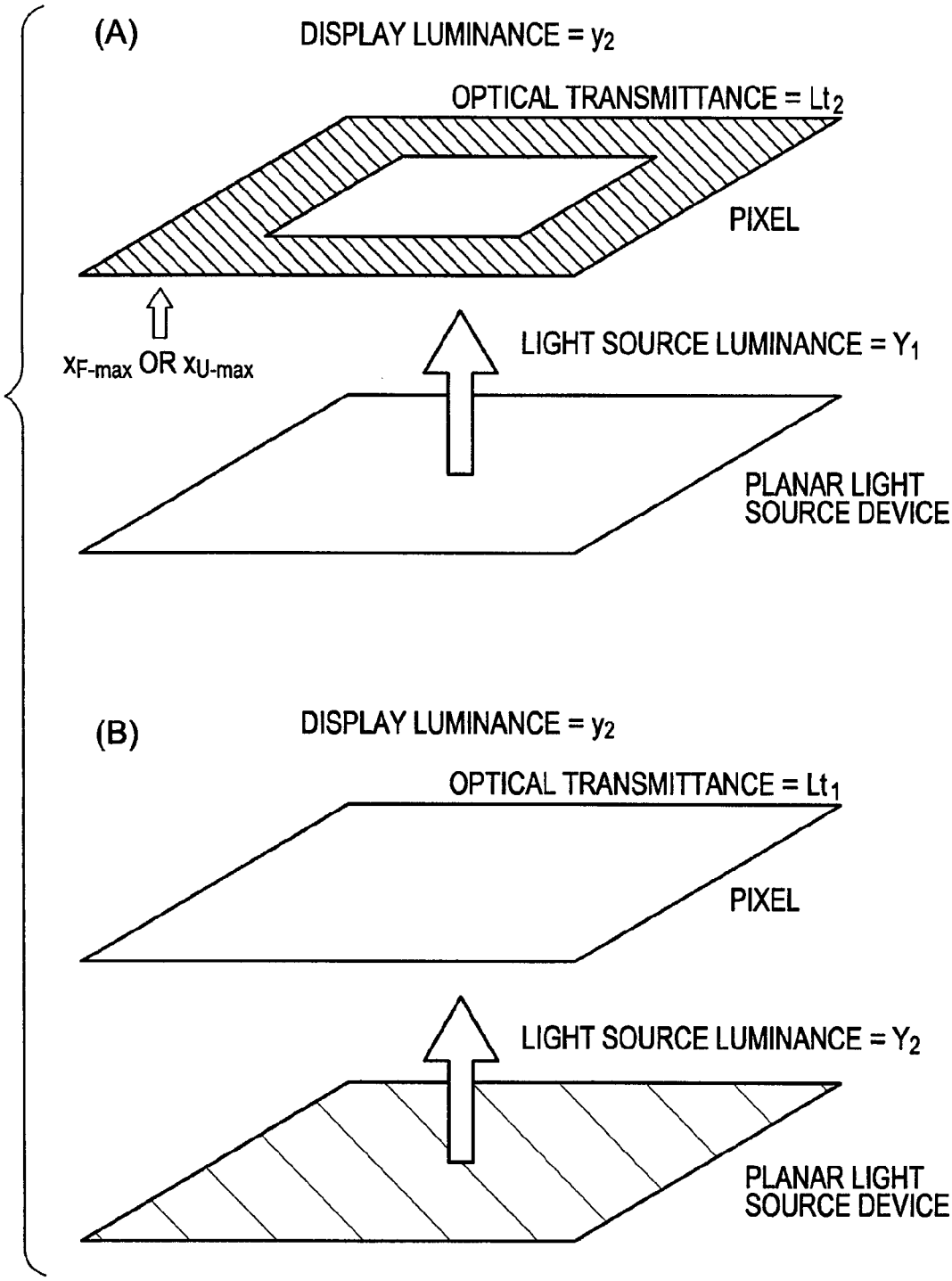
FIG. 4 is a conceptual diagram for describing a situation wherein the luminance of the planar light source device (light source luminance $Y_2$) is increased or decreased under the control of a planar light source driving circuit such that the display luminance and a second stipulated value $y_2$ when assuming that a control signal equivalent to a driving signal having the same value as a intra-frame driving signal maximum value $X_{F\text{-}max}$ is supplied to a pixel with the first embodiment and a second embodiment can be obtained.
Figure 6:
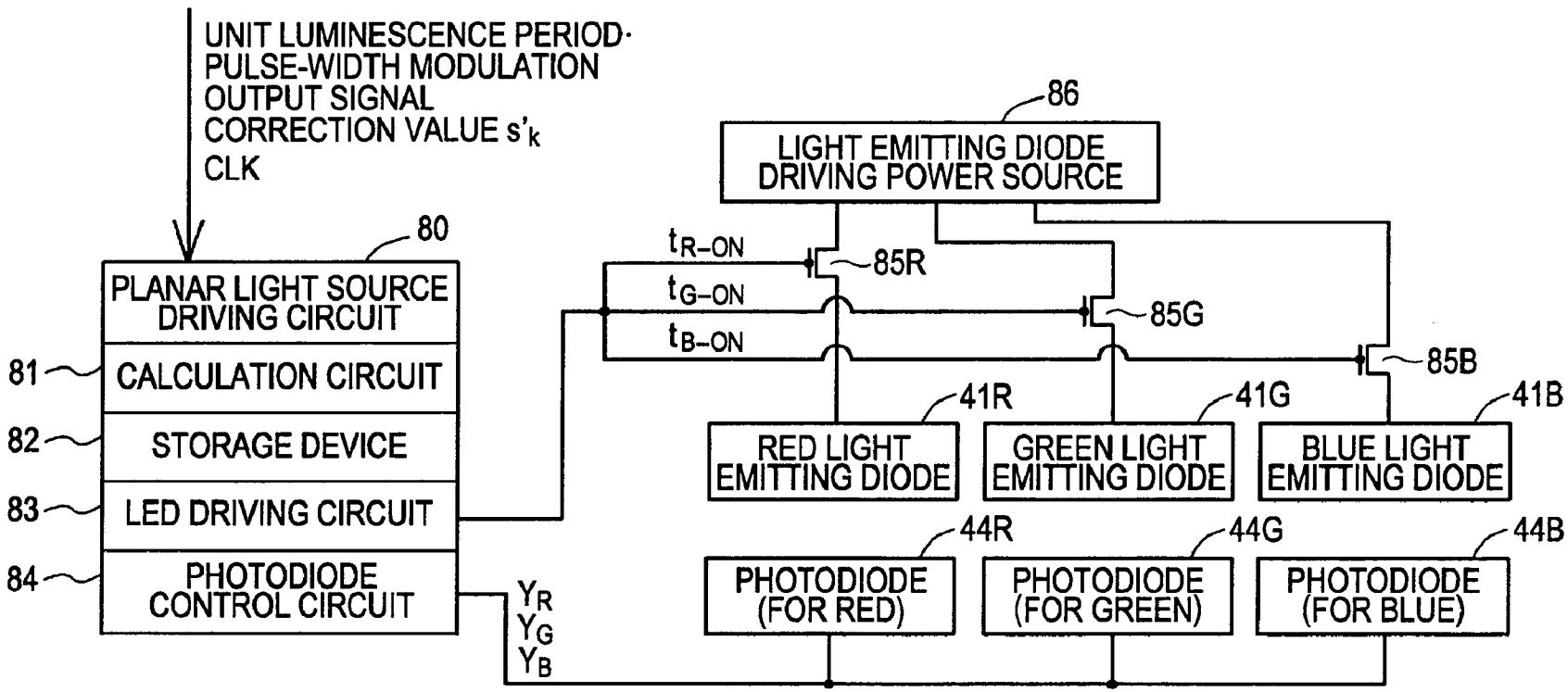
FIG. 6 is a conceptual diagram of a part of the driving circuit suitable for the use in the first embodiment.

The method for driving the liquid crystal display assembly according to the first embodiment will be described below with reference to FIGS. 4, 5, and 6.

Step 100

The driving signals R, G, B equivalent to one frame, and a clock signal CLK transmitted from a known display circuit such as a scan converter or the like, are input to the backlight control unit 70 and the liquid crystal display driving circuit 90 (see FIG. 5). Note that the driving signals R, G, B are, when assuming that the amount of input light to a pickup tube is y' for example, the output signals from the pickup tube, which are output from a broadcasting station for example, and are driving signals to be input to the liquid crystal display driving circuit 90 to control the optical transmittance Lt of a pixel, and can be represented with the function of the 0.45'th power of the amount of input light y'. The values $x_R$, $x_G$, and $x_B$ of the driving signals R, G, B equivalent to one frame that are input to the backlight control unit 70 are temporarily stored in the storage device (memory) 72 making up the backlight control unit 70. Also, the values $X_R$, $X_G$, and $X_B$ of the driving signals R, G, B equivalent to one frame that are input to the liquid crystal display driving circuit 90 are also temporarily stored in a storage device (not shown) making up the liquid crystal display driving circuit 90.

Step 110

Subsequently, the calculation circuit 71 making up the backlight control unit 70 reads out the values of the driving signals R, G, B stored in the storage device 72, and obtains the intra-frame driving signal maximum value $x_{F\text{-}max}$ that is the maximum value of the values $x_R$, $x_G$, and $x_B$ of the driving signals R, G, B for driving the sub pixels R, G, B of all the pixels making up the display area 11. Subsequently, the calculation circuit 71 stores the intra-frame driving signal maximum value $x_{F\text{-}max}$ in the storage device 72.

For example, with a certain frame, in the event that the maximum value of the value $x_R$ of a red light emitting sub-pixel driving signal (driving signal[R]) is a value equivalent to "110", the maximum value of the value $x_G$ of a green light emitting sub-pixel driving signal (driving signal[G]) is a value equivalent to "150", and the maximum value of the value $x_B$ of a blue light emitting sub-pixel driving signal (driving signal[B]) is a value equivalent to "50", the intra-frame driving signal maximum value $x_{F\text{-}max}$ is a value equivalent to "150".

Subsequently, the luminance (light source luminance $Y_2$) of the planar light source device 40 is increased or decreased under the control of the planar light source driving circuit 80 so as to obtain the luminance (the display luminance second stipulated value $y_2$ at the optical transmittance first stipulated $Lt_1$) at the planar light source device 40 when assuming that the control signals R, G, B equivalent to the driving signals R, G, B having the same value as the intra-frame driving signal maximum value $x_{F\text{-}max}$ are supplied to the sub pixels R, G, B. That is to say, as described above, the light source luminance $Y_2$ needs to be controlled for each frame so as to satisfy the following Expression (1). More specifically, the light source luminance $Y_2$ needs to be controlled based on Expression (2) that is a light source luminance control function $g(x_{nol\text{-}max})$ so as to satisfy the following Expression (1). The conceptual diagrams of such control are illustrated in FIG. 4. Note that these relations regarding control of the light source luminance $Y_2$, i.e., the relation of luminance control parameters at the planar light source unit needs to be obtained beforehand so as to obtain the value of a control signal equivalent to a driving signal having the same value as the intra-frame driving signal maximum value $x_{F\text{-}max}$, the display luminance second stipulated value $y_2$ when assuming that such a control signal is supplied to a pixel (sub pixel), the optical transmittance (aperture ratio) of each sub pixel at this time [optical transmittance second stipulated value $Lt_2$], and the display luminance second stipulated value $y_2$ when assuming that the optical transmittance (aperture ratio) of each sub pixel is the optical transmittance first stipulated value $Lt_1$.

However, when assuming that the maximum value of the driving signals (driving signals R, G, B) to be input to the liquid crystal display driving circuit 90 for driving a pixel (or each of the sub pixels R, G, B making up a pixel) is $X_{max}$, $$x_{nol\text{-}max}=x_{F\text{-}max}/x_{max}$$

holds, $a_1$ and $a_0$ are constants, and between both can be represented as follows:

$$a_1+a_0=1$$

$$0<a_0<1,\ 0<a_1<1$$

Examples of these are $a_1=0.99$ $a_0=0.01$

Also, each of the values $X_R$, $X_G$, and $X_B$ of the driving signals R, G, B takes the values of $2^8$ steps, so the value of $x_{max}$ is 255.

$$Y_2 \cdot Lt_1=Y_1 \cdot Lt_2 \tag{1}$$

$$g(x_{nol\text{-}max})=a_1 \cdot (x_{nol\text{-}max})^{2.2}+a_0 \tag{2}$$

Subsequently, the calculation circuit 71 making up the backlight control unit 70 converts the value of the obtained $g(x_{nol\text{-}max})$ into an integer corresponding to within a range of 0 through 255 based on the conversion table stored in the storage device 72. Thus, the calculation circuit 71 making up the backlight control unit 70 can obtain the value $S_R$ of the pulse-width modulation output signal for controlling the light emitting time of the red light emitting diode 41R in the planar light source device 40, the value $S_G$ of the pulse-width modulation output signal for controlling the light emitting time of the green light emitting diode 41G, and the value $S_B$ of the pulse-width modulation output signal for controlling the light emitting time of the blue light emitting diode 41$B_B$. However, with the first through fourth embodiments, let us say that $S_R=S_G=S_B=S_0$ holds.

Further, the luminance $Y_2$ of the planar light source device 40 is controlled by the driving circuits 70 and 80 based on the response speed of the liquid crystal material making up a pixel, so when assuming that the number of unit light emitting periods of the light emitting diode at one frame is K (e.g., K=10), the duty ratio at the k'th unit light emitting period (wherein k=1, 2, 3, and so on through K) is controlled.

Specifically, when assuming that the value of the pulse-width modulation output signal corresponding to the intra-frame driving signal maximum $x_{prev_F\text{-}max}$ in the previous frame is taken as $S_{prev}$, the correction value $S'_k$ of the unit light emitting period pulse-width modulation output signal is obtained from the following Expression (3) to control the duty ratio at the k'th (wherein k=1, 2, 3, and so on through K) unit light emitting period based on the values of $S_{prev}$ and $(S_0-S_{prev})$. However, k' is a coefficient, and f(k) is a function with the previously obtained k as a variable. Note that an arrangement may be made wherein a table with the values of $S_{prev}$ and $(S_0-S_{prev})$ as parameters is stored in the storage device 72 beforehand, and the correction value S'k of the unit light emitting period pulse-width modulation output signal is determined based on this table.

$$S'_k=k'\{(S_0-S_{prev})\times f(k)+S_{prev}\} \tag{3}$$

Step 120

Next, the correction value $S'_k$ (wherein k=1, 2, 3, and so on through K) of the unit light emitting period pulse-width modulation output signal obtained at the calculation circuit 71 making up the backlight control unit 70 is sent to the storage device 82 of the planar light source driving circuit 80, and is stored in the storage device 82. The clock signal CLK is also sent to the planar light source driving circuit 80 (see FIG. 6).

Step 130

Subsequently, the calculation circuit 81 determines the ON time $t_{R\text{-}ON}$ and OFF time $t_{R\text{-}OFF}$ of the red light emitting diode 41R, the ON time $t_{G\text{-}ON}$ and OFF time $t_{G\text{-}OFF}$ of the green light emitting diode 41G, and the ON time $t_{B\text{-}ON}$ and OFF time $t_{B\text{-}OFF}$ of the blue light emitting diode 41B, which make up the planar light source device 40. Note that the following $$t_{R\text{-}ON}+t_{R\text{-}OFF}=t_{G\text{-}ON}+t_{G\text{-}OFF}=t_{B\text{-}ON}+t_{B\text{-}OFF}=\text{constant value } t_{Const} \text{ (unit light emitting period)}$$

holds. Also, the duty ratio in driving based on the pulse-width modulation of the light emitting diode during a certain unit light emitting period can be represented as follows:

$$t_{ON}/(t_{ON}+t_{OFF})=t_{ON}/t_{const}$$

The signals equivalent to the ON time $t_{R\text{-}ON}$, $t_{G\text{-}ON}$, and $t_{B\text{-}ON}$ thus obtained of the red light emitting diode 41R, green light emitting diode 41G, and blue light emitting diode 41B, which make up the planar light source device 40, are sent to the LED driving circuit 83, and the switching devices 85R, 85G, and 85B are turned into an ON state during the ON time $t_{R\text{-}ON}$, $t_{G\text{-}ON}$, and $t_{B\text{-}ON}$ alone based on the values of the signals equivalent to the ON time $t_{R\text{-}ON}$, $t_{G\text{-}ON}$, and $t_{B\text{-}ON}$ from this LED driving circuit 83, and an LED driving current from the light emitting diode driving power source 86 is flowed into each of the light emitting diodes 41R, 41G, and 41B (see (A) in FIG. 2). Consequently, each of the light emitting diodes 41R, 41G, and 41B are emitted during the ON time $t_{R\text{-}ON}$, $t_{G\text{-}ON}$, and $t_{B\text{-}ON}$ during one frame time (see (B) in FIG. 2). The change state of the optical transmittance (aperture ratio) Lt of a pixel at this time is schematically illustrated in (C) in FIG. 2. Thus, the display area 11 can be illuminated with a predetermined illuminance.

Figure 8:
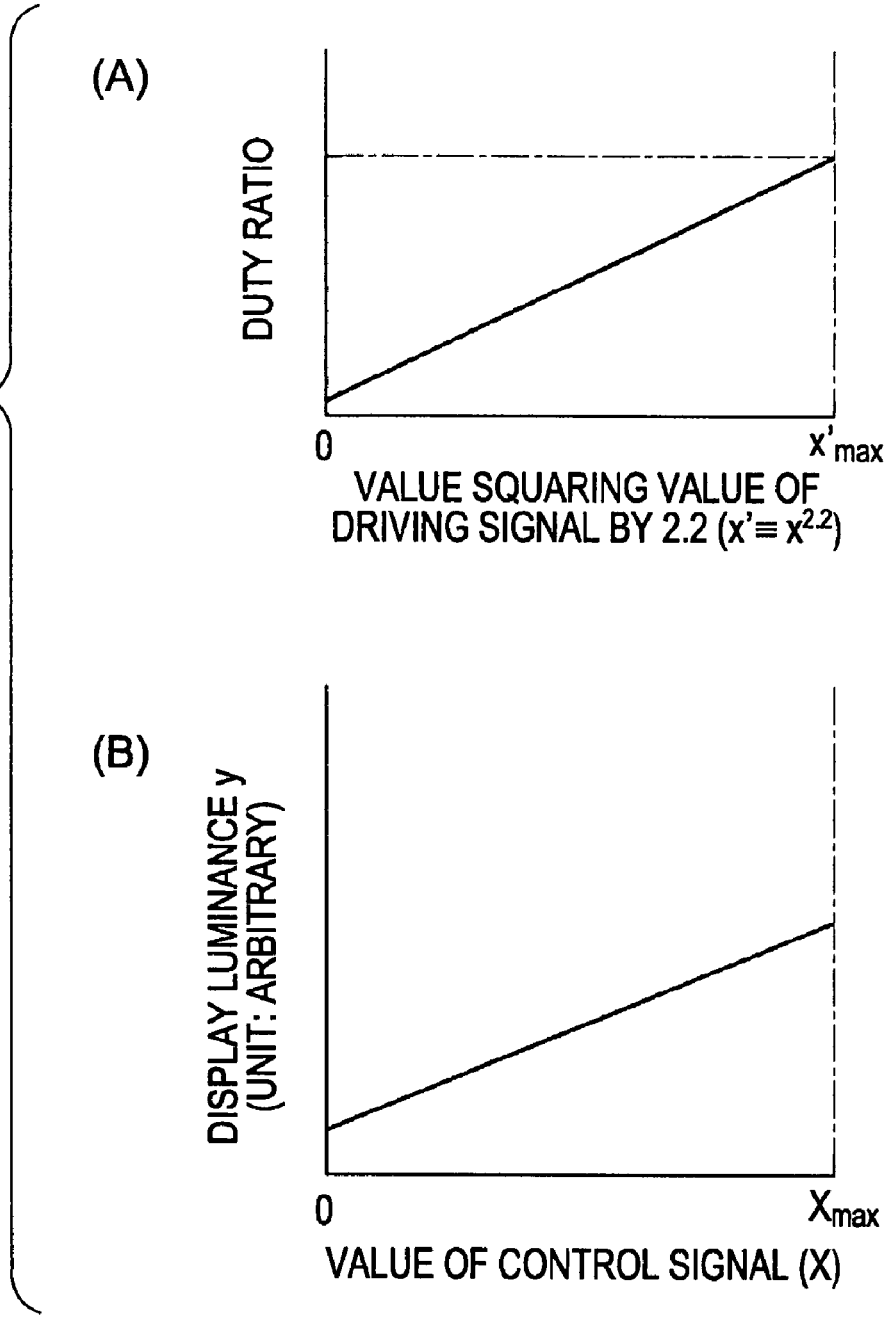
FIG. 8A is a diagram schematically illustrating the relation between the value of the value of a driving signal that is input to a liquid crystal display driving circuit for driving a sub pixel to the 2.2 'th power ($x' \equiv x^{2.2}$) and a duty ratio ($=t_{ON}/t_{const}$)
FIG. 8B is a diagram schematically illustrating the relation between the value X of a control signal for controlling the optical transmittance of a sub pixel and display luminance y.

The state thus obtained is illustrated with a solid line in FIG. 8, wherein (A) in FIG. 8 is a diagram schematically illustrating the relation between the value of the driving signal to be input to the liquid crystal display driving circuit 90 for driving a sub pixel to the 2.2'th power ($x' \equiv x^{2.2}$) and the duty ratio ($=t_{ON}/T_{const}$) and (B) in FIG. 8 is a diagram schematically illustrating the relation between the value X of a control signal for controlling the optical transmittance Lt of a sub pixel and the display luminance y.

On the other hand, the values $x_R$, $x_G$, and $x_B$ of the driving signals R, G, B input to the liquid crystal display driving circuit 90 are sent to the timing controller 91, and the timing controller 91 supplies (outputs) the control signals R, G, B equivalent to the input driving signals R, G, B to the sub pixels R, G, B. Now, if we describe the relation between the optical transmittance $Lt_2$ and the value x of the driving signal, the optical transmittance $Lt_2$ can be represented with a function F(x) of the value x of the driving signal. For example, the function F(x) can be represented with the following.

$$F(x)=b_1 \cdot x^{2.2}+b_0$$

Subsequently, if we say that the inverse function of the function F(x) is G(x), based on $$x=G(y_2/Y_2)$$

a sub pixel is driven, whereby the display luminance second stipulated value $y_2$ can be obtained. That is to say, $Y_2 \cdot Lt_1$ can be obtained based on $F(x) \cdot Y_2$, and $F(x) \cdot Y_2$ can be represented with $F(G(y_2/Y_2)) \cdot Y_2$, and further can be represented with $(y_2/Y_2)) \cdot Y_2$, whereby $y_2$ can be ultimately obtained.

Thus, the image display of one frame is performed. The operation of the color liquid crystal display device 10 and the operation of the planar light source device 40 are synchronized within one frame based on the clock signal CLK.

With the first embodiment, the luminance (light source luminance $Y_2$) of the planar light source device 40 is controlled by the driving circuits 70 and 80 so as to obtain the luminance of the pixel (the display luminance second stipulated value $y_2$ at the optical transmittance first stipulated value $Lt_1$) when assuming that a control signal equivalent to a driving signal having the same value as the intra-frame driving signal maximum value $x_{F\text{-}max}$ is supplied to a pixel for each frame in the image display of the color liquid crystal display 10, i.e., the light source luminance $Y_2$ of the planar light source device 40 is controlled for each frame, whereby reduction of power consumption of the planar light source device 40 can be realized. Moreover, the light source luminance $Y_2$ of the planar light source device 40 is controlled by the driving circuits 70 and 80 based on the response speed of the liquid crystal material making up a pixel, so even in the event that the value of the driving signal input to the liquid crystal display assembly is constant, flickering can be prevented from occurring on the display image of the color liquid crystal display 10 in a sure manner.

Second Embodiment

The second embodiment relates to the method for driving the liquid crystal display assembly according to a second arrangement of the present invention.

Figure 10:
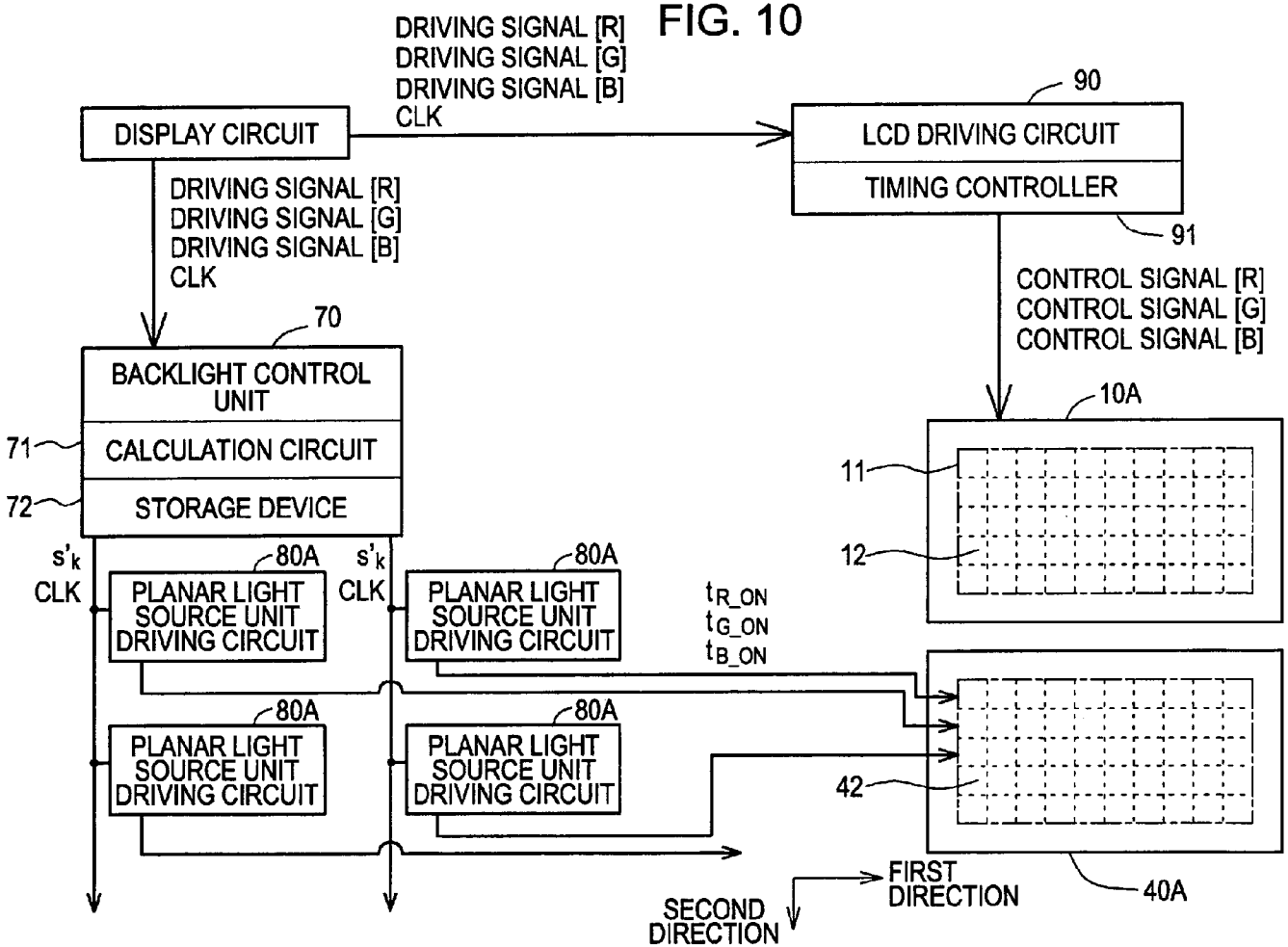
FIG. 10 is a conceptual diagram of a liquid crystal display assembly made up of the color liquid crystal display, planar light source device, and driving circuit which are suitable for the use in the second embodiment.

As shown in a conceptual diagram in FIG. 10, a transmission-type color liquid crystal display 10A, which is subjected to line sequence driving, according to the second embodiment includes a display area 11 wherein $M_0$ pixels in a first direction, and $N_0$ pixels in a second direction, and $M_0 \times N_0$ pixels in total are arrayed in a two-dimensional matrix form. Let us say that the display area 11 is divided into P×Q virtual display area units 12. Each of the display area units 12 is made up of multiple pixels. Specifically, for example, with the image display resolution thereof satisfies HDTV Specifications, and representing the number of pixels $M_0 \times N_0$ arrayed in a two-dimensional form as ($M_0$, $N_0$), (1920, 1080) can obtained for example. Also, the display area 11 made up of pixels arrayed in a two-dimension matrix form (illustrated with dashed dotted line in FIG. 10) is divided into the P×Q virtual display area units 12 (boundary is illustrated with a dotted line). Here, the value of (P, Q) is (19, 12), for example. However, the value of the display area unit 12 (and a later-described planar light source unit 42) in FIG. 10 differs from that value. Each of the display area units 12 is made up of multiple (M×N) pixels, and the number of pixels making up one display area unit 12 is around ten thousand, for example. Each pixel is configured with the three sub pixels of the sub pixels R, G, B, as with the first embodiment.

A direct planar light source device (backlight) 40A is made up of P×Q planar light source units 42 corresponding to the P×Q virtual display area units 12, and each of the planar light source units 42 illuminates the display area unit 12 corresponding to the planar light source 42 thereof from the back. Note that the planar light source device 40A is located under the color liquid crystal display 10A, but in FIG. 10, the color liquid crystal display 10A and the planar light source device 40A are illustrated separately. A schematic partial cross-sectional view of the planar light source device and the color liquid crystal display is the same as that illustrated in FIG. 7. Also, the planar light source device 40A essentially has the same configuration and constitution as the planar light source device 40 described in the first embodiment except that a partition plate (not shown) is provided, so detailed description thereof will be omitted.

The planar light source unit 42 making up the planar light source device 40A can be obtained by classifying the multiple light emitting diodes 41 as to the illumination light of the planar light source unit 42 (more specifically, the emitted light of the light emitting diodes 41) using an opaque partition plate. According to such a configuration, the luminance of the planar light source unit 42 is not influenced by the adjacent planar light source unit 42.

The driving circuit for driving the planar light source unit 42 and the color liquid crystal display 10A is made up of the backlight control unit 70 and the planar light source driving circuit 80A, and the liquid crystal display driving circuit 90, which perform the ON/OFF control of the red light emitting diode 41R, green light emitting diode 41G, and blue light emitting diode 41B, which make up the planar light source unit 42, based on the pulse-width modulation method. Note that the backlight control unit 70 and the planar light source driving circuit 80A, and the liquid crystal display driving circuit 90, according to the second embodiment essentially have the same configurations as those of the backlight control unit 70 and the planar light source driving circuit 80, and the liquid crystal display driving circuit 90, which were described in the first embodiment, so detailed description thereof will be omitted.

Note that the color liquid crystal display 10A, planar light source unit 42, driving circuits 70, 80A, and 90, according to later-described third or fourth embodiment are basically the same constitutions and configurations as those of the color liquid crystal display 10A, planar light source unit 42, driving circuits 70, 80A, and 90, according to the second embodiment.

A control signal for controlling the optical transmittance Lt of each of the pixels is supplied to each of the pixels from the driving circuit. Specifically, the control signals R, G, B for controlling the optical transmittance Lt of each of the sub pixels R, G, B are supplied to the respective sub pixels R, G, B from the liquid crystal display driving circuit 90 respectively. Note that as for this point, the same as the first embodiment can be applied, so detailed description thereof will be omitted.

The transmission-type color liquid crystal display 10A according to the second embodiment or later-described third or fourth embodiment, which is subjected to line sequence driving, includes a scan electrode (extending in a first direction) and a data electrode (extending in a second direction) which cross in a matrix form. A scan signal is input to the scan electrode to select and scan the scan electrode, and an image is displayed based on the data signal input to the data electrode, thereby making up one screen.

With the second embodiment, for each frame in the image display of the liquid crystal display, (a) the luminance (light source luminance $Y_2$) of the planar light source unit 42 is controlled by the driving circuits 70 and 80A so as to obtain the luminance (the display luminance second stipulated value $y_2$ at the optical transmittance first stipulated value $Lt_1$) of the pixel when assuming that a control signal equivalent to a driving signal having the same value as the intra-frame driving signal maximum $x_{F\text{-}max}$ that is the maximum value within the values of the driving signals to be input to the driving circuits 70, 80A, and 90 for driving all the pixels making up the display area 11 is input to a pixel, and also (b) the luminance (light source luminance $Y_2$) of the planar light source 42 is controlled by the driving circuits 70 and 80A based on the response speed of the liquid crystal material making up a pixel, and also (c) the light emitting start period of each of the planar light source units 42 is controlled by the driving circuit 80A depending on the disposed position of each of the planar light source units 42. Here, with the second embodiment, the light emitting start period of each of the planar light source units 42 corresponding to the display area unit 12 including the scan electrode, which is selected by a scan signal being input more slowly, is further delayed within one frame. However, the light emitting period of each of the planar light source units 42 is the same. The operation of the color liquid crystal display 10 and the operation of the planar light source device 40 are synchronized within one frame or over two consecutive frames based on the clock signal CLK.

Figure 9:
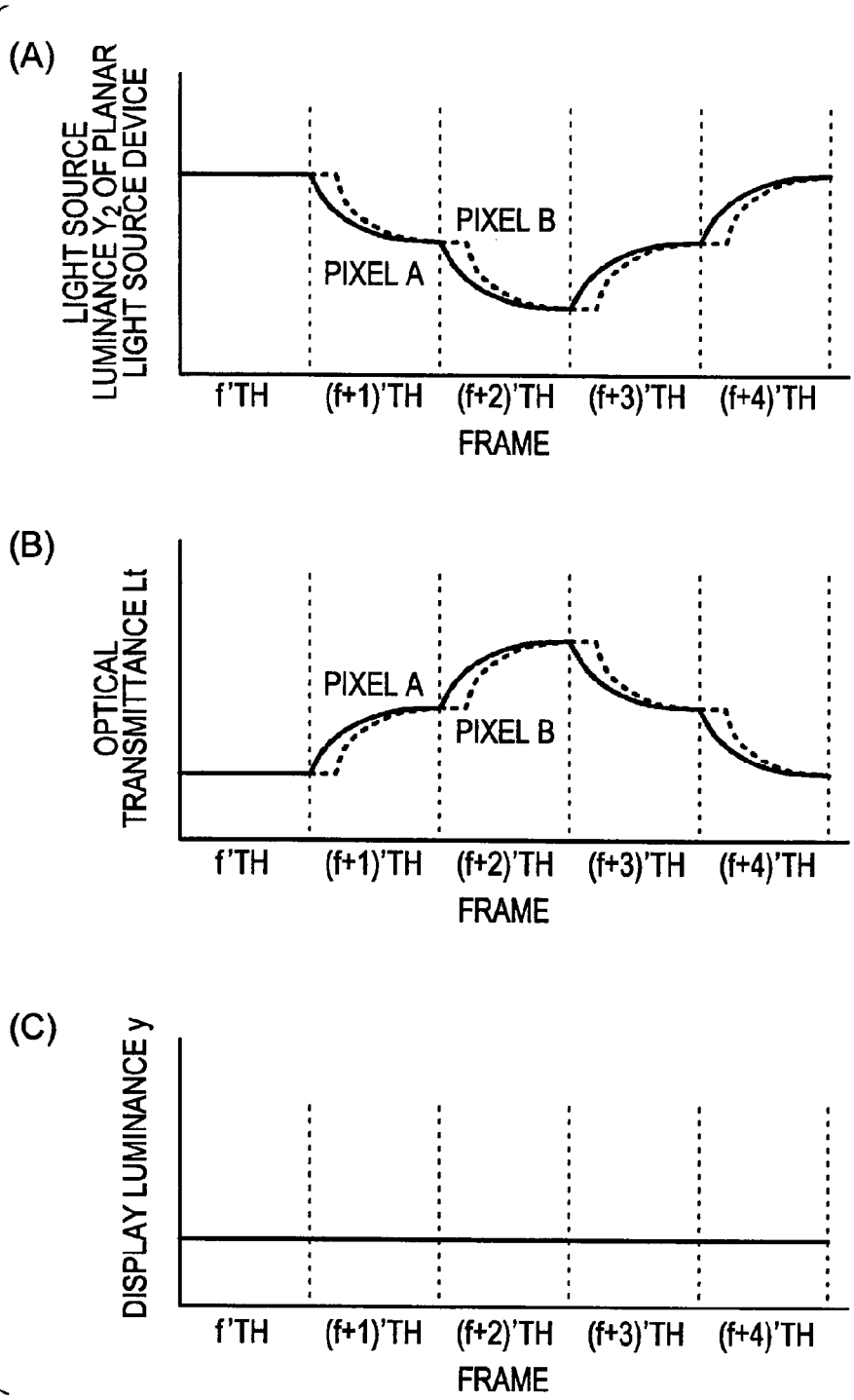
FIG. 9 is a diagram schematically illustrating the luminance of the planar light source device (light source luminance $Y_2$), the optical transmittance Lt and luminance (display luminance y) regarding a pixel A and a pixel B with a method for driving a liquid crystal display assembly according to a second embodiment.

With regard to a certain pixel (sub pixel) in the method for driving the liquid crystal display assembly according to the second embodiment, the luminance (light source luminance $Y_2$) of the planar light source device, and the optical transmittance Lt and luminance (display luminance y) of the pixel are schematically illustrated in FIG. 9. Here, the solid line in (A) in FIG. 9 illustrates the light source luminance $Y_2$ of the planar light source unit 42 corresponding to the display area unit 12 where a pixel A is included, and the dotted line in (A) in FIG. 9 illustrates the light source luminance $Y_2$ of the planar light source unit 42 corresponding to the display area unit 12 where a pixel B is included. Also, the solid line in (B) in FIG. 9 is a diagram schematically illustrating the optical transmittance Lt of the pixel A, and the dotted line in (B) in FIG. 9 is a diagram schematically illustrating the optical transmittance Lt of the pixel B. Further, (C) in FIG. 9 is a diagram schematically illustrating the display luminance y of the pixel A and pixel B. Here, the horizontal axes in FIG. 9 illustrate the time course (number of frames) of image display. Also, the pixel A is located at the upper portion of the liquid crystal display, the pixel B is located at the lower portion of the liquid crystal display, and the pixel B is selected by a scan signal being input thereto more slowly within one frame as compared with the pixel A.

As described above, the liquid crystal material has a limited response speed. Therefore, the optical transmittance Lt of a pixel varies such as shown with the solid line and dotted line in (B) in FIG. 9. With the method for driving the liquid crystal display assembly according to the second embodiment, as shown with the solid line and dotted line in (A) in FIG. 9, the light source luminance $Y_2$ of the planar light source unit 42 is controlled by the driving circuit 80A based on the response speed of the liquid crystal material making up a pixel. Therefore, even in the event that the value of the driving signal externally input to the liquid crystal display assembly to drive the pixel is constant, the display luminance such as shown with the solid line in (C) in FIG. 9 is obtained at both the pixel A and pixel B, which is different from the existing technique shown in FIG. 15, whereby no flickering occurs on the display image of the color liquid crystal display 10A.

With the method for driving the liquid crystal display assembly according to the second embodiment, the same steps as Step 100 through Step 130 need to be executed. However, in the same step as Step 130 of the first embodiment, processing needs to be performed wherein following predetermined delay time Δt elapsing from the light emitting start period of the planar light source unit 42 belonging to a first line, the light emitting of the planar light source unit 42 belonging to a second line is started, following predetermined delay time Δt elapsing from the light emitting start period of the planar light source unit 42 belonging to the second line, the light emitting of the planar light source unit 42 belonging to a third line is started, and following predetermined delay time $\Delta T(=q\times\Delta t)$ elapsing from the light emitting start period of the planar light source unit 42 belonging to a q'th line, the light emitting of the planar light source unit 42 belonging to a (q+1) line is started.

With the second embodiment, as with the first embodiment, for each frame in the image display of the liquid crystal display, the luminance (light source luminance $Y_2$) of the planar light source unit 42 is controlled by the driving circuits 70 and 80A so as to obtain the luminance (the display luminance second stipulated value $y_2$ at the optical transmittance first stipulated value $Lt_1$) of the pixel when assuming that a control signal equivalent to a driving signal having the same value as the intra-frame driving signal maximum $x_{F\text{-}max}$ is supplied to a pixel, i.e., the light source luminance $Y_2$ of the planar light source unit 42 is controlled for each frame, whereby reduction of power consumption of the planar light source device 40A can be realized. Moreover, the light source luminance $Y_2$ of the planar light source unit 42 is controlled by the driving circuit 70 and 80A based on the response speed of the liquid crystal material making up a pixel, so even in the event that the value of the driving signal to be input to the liquid crystal display assembly is constant, flickering can be prevented from occurring on the display image of the color liquid crystal display 10A in a sure manner. Further, with the method for driving the liquid crystal display assembly according to the second embodiment, the light emitting start period of each of the planar light source units 42 is controlled by the driving circuit 80A depending on the disposed position of each of the planar light source units 42, whereby control of the display image of the liquid crystal display can be performed in a much more exact and precise manner.

Third Embodiment

The third embodiment relates to the method for driving the liquid crystal display assembly according to a third arrangement of the present invention.

The display area made up of pixels arrayed in a two-dimensional matrix form is divided into P×Q display area units, but if this state is represented with rows and lines, it can be said that this state is divided into Q-row x P-line display area units. Also, the display area unit 12 is made up of multiple (M×N) pixels, if this state is represented with rows and lines, it can be said that this state is made up of N-row x M-line pixels. Note that there is a case wherein the display area unit and the planar light source unit, which are arrayed in a two-dimensional matrix form, and located at the position of q-row x p-line [however, q=1, 2, and so on through Q, and p=1, 2, and so on through P], are represented as display area units $\mathbf{12}_{(q,\,p)}$ and planar light source units $\mathbf{42}_{(q,\,p)}$ respectively, and elements and items relating to the display area units $\mathbf{12}_{(q,\,p)}$ and planar light source units $\mathbf{42}_{(q,\,p)}$ are appended with a subscript (q, p) or –(q, p).

With the first and second embodiments, the luminance (light source luminance $Y_2$) of the planar light source device 40 or planar light source unit 42 is controlled by the driving circuits 70 and 80 (80A) so as to obtain the luminance (the display luminance second stipulated value $y_2$ at the optical transmittance first stipulated value $Lt_1$) of the pixel when assuming that a control signal equivalent to a driving signal having the same value as the intra-frame driving signal maximum value $x_{F\text{-}max}$ that is the maximum value of the values of the driving signals to be input to the driving circuits 70, 80 (80A), and 90 to drive all the pixels making up the display area 11 is supplied to a pixel. That is to say, the planar light source device 40 is not subjected to division driving, and also the planar light source unit 42 is not subjected to driving divided for each unit (division driving). In other words, the planar light source device 40 evenly illuminates the display area 11, and also the planar light source unit 42 evenly illuminates the display area unit 12, and accordingly, there is essentially no difference regarding the light source luminance $Y_2$ between the planar light source units 42.

On the other hand, with the method for driving the liquid crystal display assembly according to the third embodiment, the planar light source unit 42 is subjected to driving divided for each unit (division driving). In other words, the planar light source unit 42 illuminates the display area unit 12, but there may be difference regarding the light source luminance $Y_2$ between the planar light source units 42. That is to say, with the third embodiment, for each frame of the image display of the liquid crystal display, (a) with each of the planar light source units $\mathbf{42}_{(q,p)}$, the luminance (light source luminance $Y_{2\text{-}(q,\,p)}$) of the planar light source units $\mathbf{42}_{(q,\,p)}$ corresponding to the display area units $\mathbf{12}_{(q,\,p)}$ is controlled by the driving circuits 70 and $\mathbf{80}A_{(q,\,p)}$ so as to obtain the luminance (the display luminance second stipulated value $y_{2\text{-}(q,\,p)}$ at the optical transmittance first stipulated value $Lt_1$) of the pixel when assuming that a control signal equivalent to a driving signal having the same value as the intra-display-area-unit driving signal maximum value $x_{U\text{-}max}$ that is the maximum value of the values of the driving signals to be input to the driving circuits 70, $\mathbf{80}A_{(q,\,p)}$, and 90 to drive all the pixels making up the display areas $\mathbf{12}_{(q,\,p)}$ is supplied to a pixel, and also (b) the luminance (light source luminance $Y_{2\text{-}(q,\,p)}$) of the planar light source units $\mathbf{42}_{(q,\,p)}$ is controlled by the driving circuits 70 and $\mathbf{80}A_{(q,\,p)}$ based on the response speed of the liquid crystal material making up a pixel.

Figure 11:
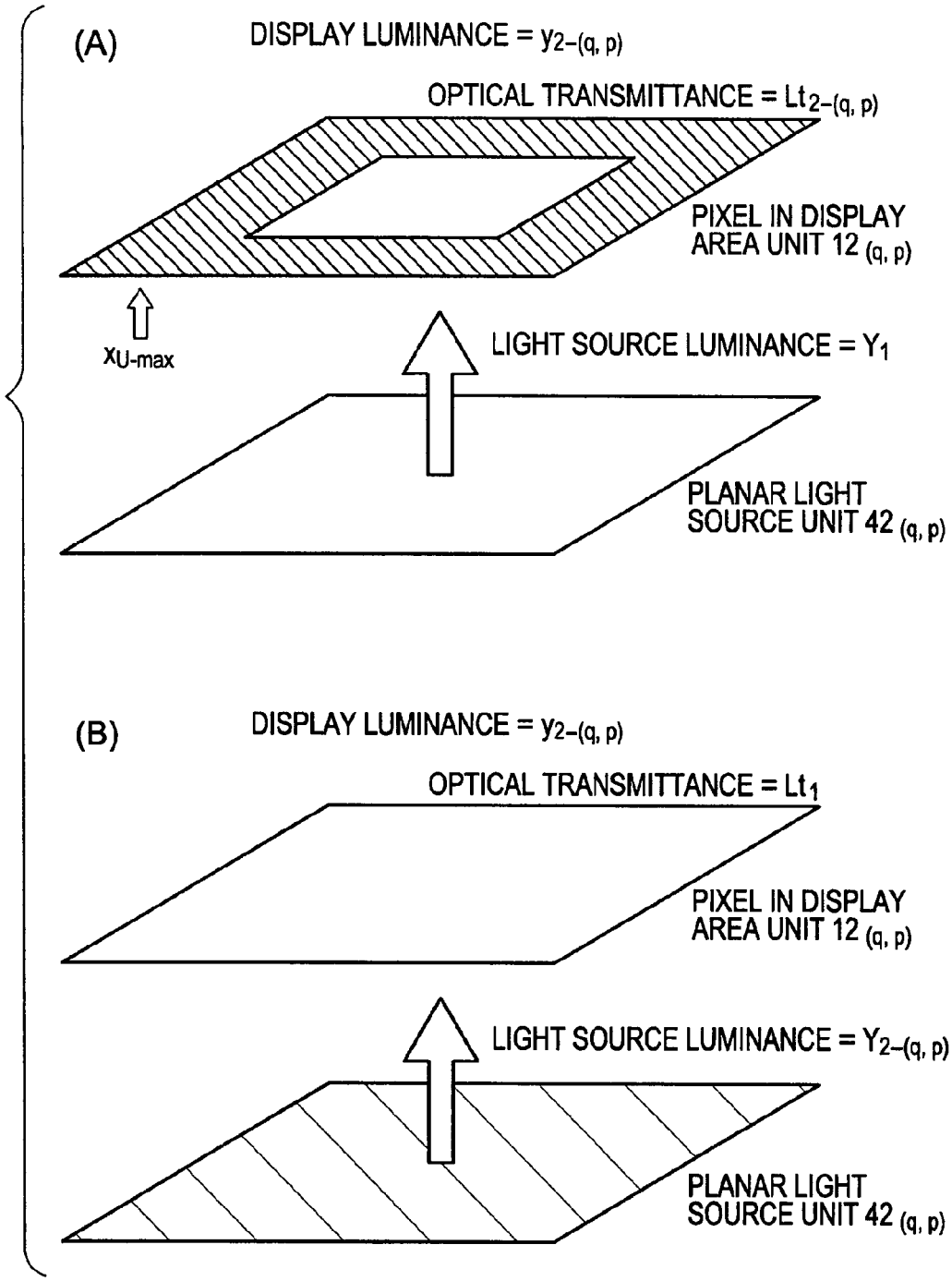
FIG. 11 is a conceptual diagram for describing a situation wherein the luminance of a planar light source unit (light source luminance $Y_{2\text{-}(q,p)}$) is increased or decreased under the control of a planar light source unit driving circuit such that the display luminance and a second stipulated value $y_{2\text{-}(q,p)}$ when assuming that a control signal equivalent to a driving signal having the same value as a intra-display-area-unit driving signal maximum value $X_{U\text{-}max}$ is supplied to a pixel with a third embodiment can be obtained.
Figure 12:
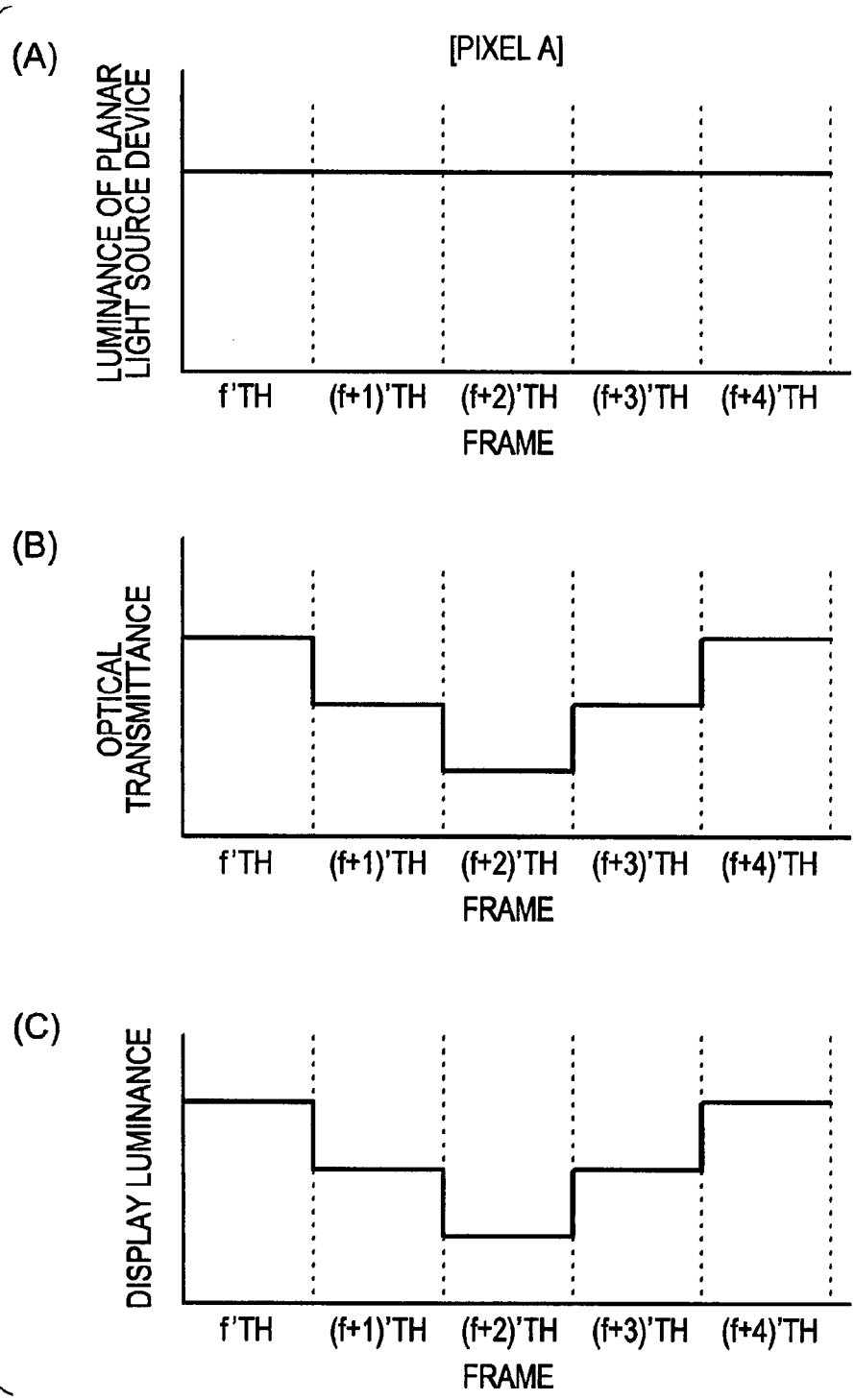
FIG. 12 is a diagram schematically illustrating the luminance of the planar light source device (light source luminance), the optical transmittance of the pixel A, and the change of luminance (display luminance) for each frame with the pixel A when assuming that the luminance of the planar light source device (light source luminance) is constant in an existing technique.
Figure 13:
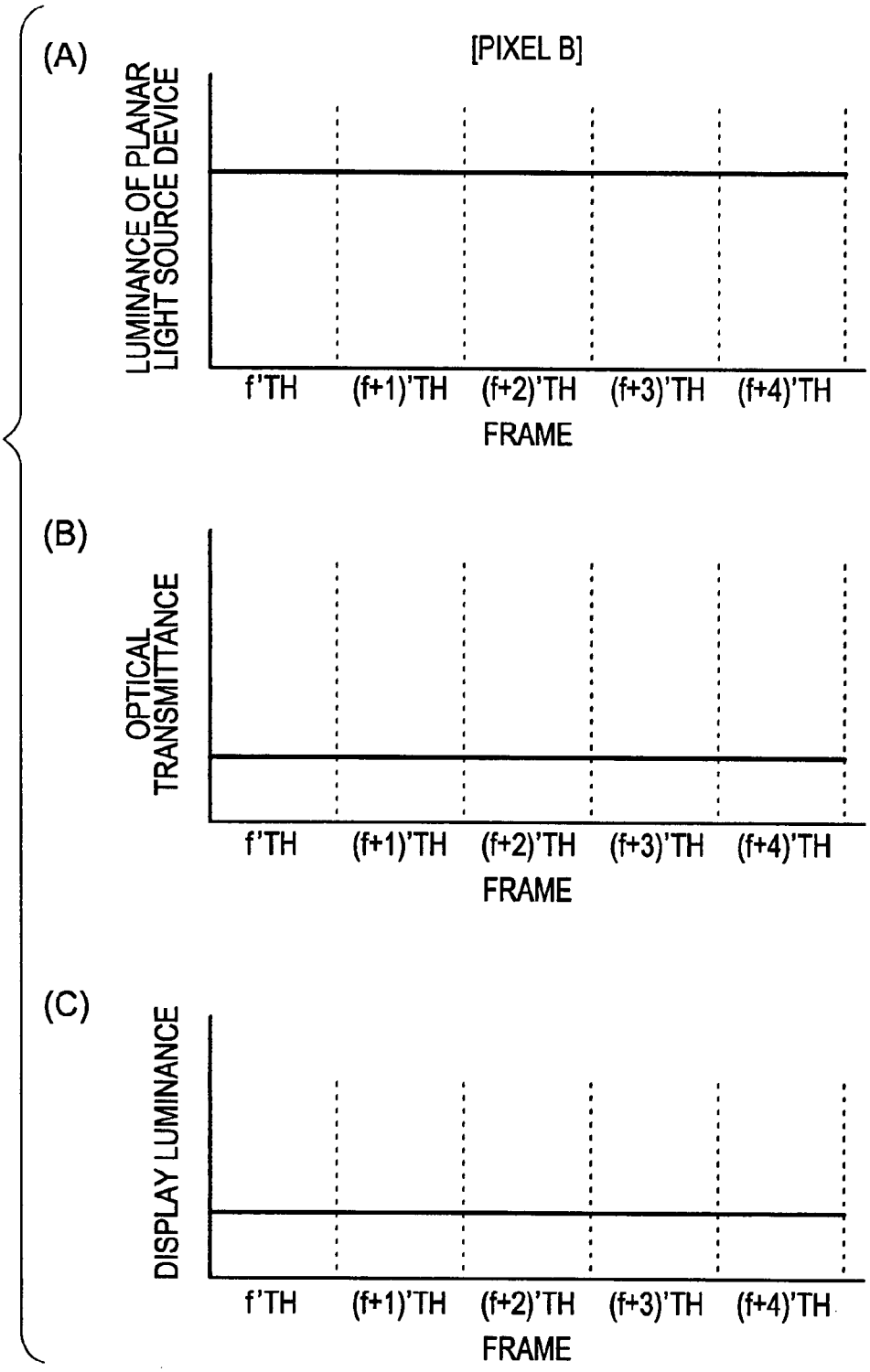
FIG. 13 is a diagram schematically illustrating the luminance of the planar light source device (light source luminance), the optical transmittance of the pixel B, and the change of luminance (display luminance) for each frame with the pixel B when assuming that the luminance of the planar light source device (light source luminance) is constant in an existing technique.
Figure 14:
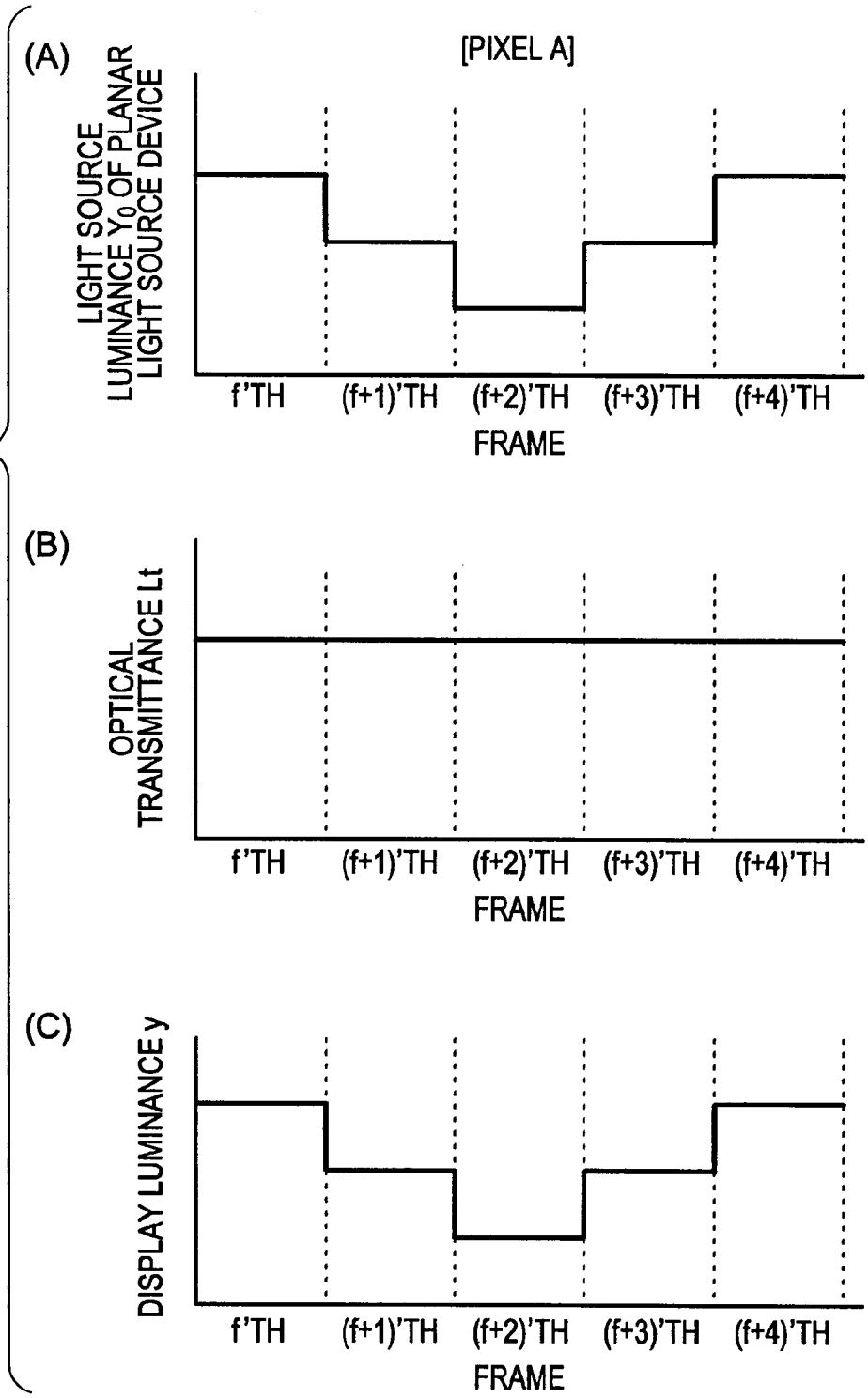
FIG. 14 is a diagram schematically illustrating the luminance of the planar light source device (light source luminance), the optical transmittance of the pixel A, and the change of luminance (display luminance) for each frame with the pixel A when assuming that the luminance of the planar light source device (light source luminance) is variable in an existing technique.

Let us say that with regard to a certain pixel (sub pixel) in the method for driving the liquid crystal display assembly according to the third embodiment, the luminance (light source luminance $Y_{2\text{-}(q,\,p)}$) of the planar light source units $\mathbf{42}_{(q,\,p)}$ and the optical transmittance Lt and luminance (display luminance $y_{2\text{-}(q,\,p)}$) of the pixel are the same as those schematically illustrated in FIGS. 1 and 3. That is to say, let us say for the sake of convenience that the luminance (light source luminance $Y_2$) of the planar light source unit 42 corresponding to the display area unit 12 including a pixel A, and the luminance (light source luminance $Y_2$) of the planar light source unit 42 corresponding to the display area unit 12 including a pixel B are set to the same. However, as with the second embodiment, the pixel A is located at the upper portion of the color liquid crystal display 10A, the pixel B is located at the lower portion of the color liquid crystal display 10, and the pixel B is selected by a scan signal being input thereto more slowly within one frame as compared with the pixel A. In the conceptual views in FIG. 11, a situation is illustrated wherein with the third embodiment, the luminance (light source luminance $Y_{2\text{-}(q,\,p)}$) of the planar light source unit is increased or decreased under the control of the planar light source unit driving circuit such that the planar light source unit can be obtain the display luminance second stipulated value $y_{2\text{-}(q,\,p)}$ when assuming that a control signal equivalent to a driving signal having the same value as the intra-display-area-unit driving signal maximum value $x_{U\text{-}max}$ is supplied to a pixel.

The method for driving the planar light source device according to the third embodiment will be described below with reference to FIG. 10 again.

Step 300

As with Step 100 in the first embodiment, the driving signals R, G, B equivalent to one frame and clock signal CLK, which were transmitted from a known display circuit such as a scan converter or the like, are input to the backlight control unit 70 and the liquid crystal display driving circuit 90 (see FIG. 10). Subsequently, the values $x_R$, $x_G$, and $x_B$ of the driving signals R, G, B equivalent to one frame input to the backlight control unit 70 are temporarily stored in the storage device (memory) 72 making up the backlight control unit 70. Also, the values $x_R$, $x_G$, and $x_B$ of the driving signals R, G, B equivalent to one frame input to the liquid crystal display driving circuit 90 are temporarily stored in a storage device (not shown) making up the liquid crystal display driving circuit 90.

Step 310

Subsequently, the calculation circuit 71 making up the backlight control unit 70 reads out the values of the driving signals R, G, B stored in the storage device 72, and obtains the intra-display-area-unit driving signal maximum value $x_{U\text{-}max(q,\,p)}$ that is the maximum value of the values $x_{R\text{-}(q,\,p)}$, $x_{G\text{-}(q,\,p)}$ and $x_{B\text{-}(q,\,p)}$ of the driving signals R, G, B for driving the sub pixels R, G, $B_{(q,\,p)}$ of all the pixels making up the (p, q)'th display area unit $\mathbf{12}_{(q,\,p)}$ with the (p, q)'th [however, first p=1 and q=1] display area unit $\mathbf{12}_{(q,\,p)}$. Subsequently, the calculation circuit 71 stores the intra-display-area-unit driving signal maximum value $x_{U\text{-}max(q,\,p)}$ in the storage device 72. This step is executed as to all of m=1, 2, and so on through M, and n=1, 2, and so on through N, i.e., as to the M×N pixels.

For example, in the event that $x_{R\text{-}(q,\,p)}$ is a value equivalent to "110", $x_{G\text{-}(q,\,p)}$ is a value equivalent to "150", and $x_{B\text{-}(q,\,p)}$ is a value equivalent to "50", $x_{U\text{-}max(q,\,p)}$ is a value equivalent to "150".

This operation is repeated from (p, q)=(1, 1) to (P, Q), and the intra-display-area-unit driving signal maximum value $x_{U\text{-}max(q,\,p)}$ with all the display area units $\mathbf{12}_{(q,\,p)}$ is stored in the storage device 72.

Subsequently, the luminance (light source luminance $Y_{2\text{-}(q,p)}$) of the planar light source units $\mathbf{42}_{(q,p)}$ corresponding to the display area units $\mathbf{12}_{(q,\,p)}$ is increased or decreased under the control of the above planar light source unit driving circuit $\mathbf{80}A_{(q,\,p)}$ such that the planar light source units $\mathbf{42}_{(q,\,p)}$ can obtain the luminance (the display luminance second stipulated value $y_{2\text{-}(q,p)}$ at the optical transmittance first stipulated value $Lt_1$) when assuming that the control signals R, G, $B_{(q,\,p)}$ equivalent to the driving signals R, G, $B_{(q,\,p)}$ having the same value as the intra-display-area-unit driving signal maximum value $x_{U\text{-}max(q,\,p)}$ are supplied to the sub pixels R, G, $B_{(q,\,p)}$. That is to say, as described above, the light source luminance $Y_{2\text{-}(q,p)}$ needs to be controlled for each frame so as to satisfy Expression (1). More specifically, the light source luminance $Y_{2\text{-}(q,p)}$ needs to be controlled based on Expression (2) serving as a light source luminance control function $g(x_{nol\text{-}max})$ so as to satisfy Expression (1). Such control conceptual views are the same as those illustrated in FIG. 4. Note that these relations regarding control of the light source luminance $Y_2$, i.e., the relation of the luminance control parameters in the planar light source unit, needs to be obtained beforehand so as to obtain the intra-display-area-unit driving signal maximum value $x_{U\text{-}max}$, the value of a control signal equivalent to a driving signal having the same value as this maximum value $x_{U\text{-}max}$, the display luminance second stipulated value $y_2$ when assuming that such a control signal is supplied to a pixel (sub pixel), the optical transmittance (aperture ratio) of each sub pixel at this time (optical transmittance second stipulated value $Lt_2$), and the display luminance second stipulated value $y_2$ when assuming that the optical transmittance (aperture ratio) of each sub pixel is the optical transmittance first stipulated value $Lt_1$.

Subsequently, the calculation circuit 71 making up the backlight control unit 70 converts the value of the obtained $g(x_{nol\text{-}max})$ into the corresponding integer within a range of 0 through 255 based on the table stored in the storage device 72. Thus, with the calculation circuit 71 making up the backlight control unit 70, the value $S_{R\text{-}(q,\,p)}$ of the pulse-width modulation output signal for controlling the light emitting time of the red light emitting diodes $\mathbf{41}R_{(q,\,p)}$, the value $S_{G\text{-}(q,\,p)}$ of the pulse-width modulation output signal for controlling the light emitting time of the green light emitting diodes $\mathbf{41}G_{(q,\,p)}$, and the value $S_{B\text{-}(q,\,p)}$ of the pulse-width modulation output signal for controlling the light emitting time of the blue light emitting diodes $\mathbf{41}B_{(q,\,p)}$ can be obtained. However, let us say that $S_{R\text{-}(q,\,p)}=S_{G\text{-}(q,\,p)}=S_{B\text{-}(q,\,p)}=S_{0\text{-}(q,\,p)}$ holds.

Subsequently, as with the above description in Step 110 in the first embodiment, the correction value $S'_{k\text{-}(q,\,p)}$ of the unit light emitting period pulse-width modulation output signal at the k'th unit light emitting period is obtained.

Step 320

Next, as with Step 120 in the first embodiment, the correction value $S'_{k\text{-}(q,\,p)}$ of the unit light emitting period pulse-width modulation output signal obtained at the calculation circuit 71 making up the backlight control unit 70 is sent to the storage device 82 of the planar light source driving circuits $\mathbf{80}A_{(q,\,p)}$ provided corresponding to the planar light source units $\mathbf{42}_{(q,\,p)}$ and is stored in the storage device 82. The clock signal CLK is also sent to the planar light source unit driving circuits $\mathbf{80}A_{(q,\,p)}$ (see FIG. 10).

Step 330

Subsequently, the same step as Step 130 in the first embodiment is executed. Subsequently, the signals equivalent to the ON time $t_{R\text{-}ON\text{-}(q,p)}$, $t_{G\text{-}ON\text{-}(q,p)}$, and $t_{B\text{-}ON\text{-}(q,p)}$ of the red light emitting diodes $\mathbf{41}R_{(q,\,p)}$, green light emitting diodes $\mathbf{41}G_{(q,p)}$, and blue light emitting diodes $\mathbf{41}B_{(q,p)}$, which make up the planar light source units $\mathbf{42}_{(q,\,p)}$, are sent to the LED driving circuit 83, the switching devices $\mathbf{85}R_{(q,\,p)}$, $\mathbf{85}G_{(q,\,p)}$, and $\mathbf{85}B_{(q,\,p)}$ are turned into an ON state only during the ON time $t_{R\text{-}ON\text{-}(q,p)}$, $t_{G\text{-}ON\text{-}(q,p)}$ and $t_{B\text{-}ON\text{-}(q,p)}$ based on the values of the signals equivalent to the ON time $t_{R\text{-}ON\text{-}(q,p)}$, $t_{G\text{-}ON\text{-}(q,p)}$ and $t_{B\text{-}ON\text{-}(q,p)}$ from the LED driving circuit 83, and the LED driving current from the light emitting diode driving power source 86 is flowed to each of the light emitting diodes $\mathbf{41}R_{(q,p)}$, $\mathbf{41}G_{(q,p)}$, and $\mathbf{41}B_{(q,p)}$. Consequently, the respective light emitting diodes $\mathbf{41}R_{(q,\,p)}$, $\mathbf{41}G_{(q,\,p)}$, and $\mathbf{41}B_{(q,\,p)}$ are emitted only during the ON time $t_{R\text{-}ON\text{-}(q,\,p)}$, $t_{G\text{-}ON\text{-}(q,\,p)}$ and $t_{B\text{-}ON\text{-}(q,\,p)}$ within one frame time. Thus, the (p, q)'th display area unit $\mathbf{12}_{(q,\,p)}$ is illuminated with predetermined illuminance.

On the other hand, the values $x_{R\text{-}(q,\,p)}$, $x_{G\text{-}(q,\,p)}$, and $x_{B\text{-}(q,\,p)}$ of the driving signals R, G, B input to the liquid crystal display driving circuit 90 are processed at the timing controller 91 as with the first embodiment, and the control signals R, G, $B_{(q,\,p)}$ equivalent to the driving signals R, G, $B_{(q,\,p)}$ are supplied (output) to the sub pixels R, G, $B_{(q,\,p)}$. Subsequently, the optical transmittance (aperture ratio) Lt of the sub pixels R, G, $B_{(q,\,p)}$ is controlled based on the values $X_{R\text{-}(q,\,p)}$, $X_{G\text{-}(q,\,p)}$, and $X_{B\text{-}(q,\,p)}$ of the control signals R, G, $B_{(q,\,p)}$.

With the method for driving the liquid crystal display assembly according to the third embodiment, for each frame of the image display of the liquid crystal display, the luminance (light source luminance $Y_{2\text{-}(q,\,p)}$) of the planar light source units $\mathbf{42}_{(q,p)}$ is controlled by the driving circuits 70 and $\mathbf{80}A_{(q,p)}$ so as to obtain the luminance (the display luminance second stipulated value $y_{2\text{-}(q,\,p)}$ at the optical transmittance first stipulated value $Lt_1$) when assuming that a control signal equivalent to a driving signal having the same value as the intra-display-area-unit driving signal maximum value $x_{U\text{-}max(q,\,p)}$ is supplied to a pixel, i.e., the luminance of the planar light source units $\mathbf{42}_{(q,\,p)}$ is controlled by the driving circuits 70, $\mathbf{80}A_{(q,\,p)}$ for each frame, whereby reduction of power consumption of the planar light source device 40 can be realized, and also a high contrast ratio can be obtained. Moreover, the light source luminance $Y_{2\text{-}(q,\,p)}$ of the planar light source unit 42 is controlled by the driving circuits 70, $\mathbf{80}A_{(q,\,p)}$ based on the response speed of the liquid crystal material making up a pixel, so even in the event that the values of the driving signals to be input to the liquid crystal display assembly are constant, flickering can be prevented from occurring on the display image of the color liquid crystal display 10A in a sure manner.

Fourth Embodiment

The fourth embodiment is a modification of the third embodiment. With the method for driving the liquid crystal display assembly according to the fourth embodiment, for each frame of the image display of the liquid crystal display, the light emitting period of each of the planar light source units 42 is controlled by the driving circuit depending on the disposed position of each of the planar light source units 42. Specifically, with the fourth embodiment, the light emitting start period of each of the planar light source units 42 corresponding to the display area unit 12 including the scan electrode that is selected by a scan signal being input more slowly within one frame is further delayed. That is to say, with the fourth embodiment, the same driving as described in the second embodiment is performed.

Specifically, the method for driving the liquid crystal display assembly according to the fourth embodiment executes Step 300 through Step 330 according to the third embodiment. However, in the same step as Step 330 according to the third embodiment, as with the second embodiment, processing needs to be performed wherein following predetermined delay time Δt elapsing from the light emitting start period of the planar light source unit 42 belonging to a first line (q=1), the light emitting of the planar light source unit 42 belonging to a second line (q=2) is started, following predetermined delay time Δt elapsing from the light emitting start period of the planar light source unit 42 belonging to the second line (q=2), the light emitting of the planar light source unit 42 belonging to a third line (q=3) is started, and following predetermined delay time ΔT(=q'×Δt) elapsing from the light emitting start period of the planar light source unit 42 belonging to a q"th line, the light emitting of the planar light source unit 42 belonging to a (q'+1) line is started.

With the fourth embodiment, as with the third embodiment, for each frame of the image display of the color liquid crystal display 10A, the luminance (light source luminance $Y_{2-(q,p)}$) of the planar light source units $\mathbf{42}_{(q,p)}$ is controlled by the driving circuits 70 and $\mathbf{80}A_{(q,p)}$ so as to obtain the luminance (the display luminance second stipulated value $y_{2-(q,p)}$ at the optical transmittance first stipulated value $Lt_1$) of the pixel when assuming that a control signal equivalent to a driving signal having the same value as the intra-display-area-unit driving signal maximum $x_{U-max(q,p)}$ is supplied to a pixel, i.e., the light source luminance $Y_{2-(q,p)}$ of the planar light source units $\mathbf{42}_{(q,p)}$ is controlled for each frame, whereby reduction of power consumption of the planar light source device 40A can be realized. Moreover, the light source luminance $Y_{2-(q,p)}$ of the planar light source units $\mathbf{42}_{(q,p)}$ is controlled by the driving circuit 70 and $\mathbf{80}A_{(q,p)}$ based on the response speed of the liquid crystal material making up a pixel, so even in the event that the value of the driving signal to be input to the liquid crystal display assembly is constant, flickering can be prevented from occurring on the display image of the color liquid crystal display 10A in a sure manner. Further, with the method for driving the liquid crystal display assembly according to the fourth embodiment, the light emitting start period of each of the planar light source units $\mathbf{42}_{(q,p)}$ is controlled by the driving circuit $\mathbf{80}A_{(q,p)}$ depending on the disposed position of each of the planar light source units $\mathbf{42}_{(q,p)}$ whereby control of the display image of the liquid crystal display can be performed in a much more exact and precise manner.

So far the present invention has been described based on the preferred embodiments, but the present invention is not restricted to these embodiments. The constitutions and configurations of the transmission-type color liquid crystal display, planar light source unit, and liquid crystal display assembly, which have been described with the embodiments, are examples, and the members and materials and so forth making up these are also examples, which can be modified as appropriate. An arrangement may be made wherein the temperature of a light emitting diode is monitored by a temperature sensor, and the result thereof is fed back to the planar light source driving circuit 80 or planar light source unit driving circuit 80A, thereby performing the luminance compensation (correction) and temperature control of the planar light source device 40 or planar light source unit 42. With the embodiments, description has been made assuming that the display area of the liquid crystal display is divided into P×Q virtual display area units, but in some cases, the transmission-type liquid crystal, display may have a configuration divided into P×Q actual display area units.

It should be understood by those skilled in the art that various modifications, combinations, sub-combinations and alterations may occur depending on design requirements and other factors insofar as they are within the scope of the appended claims or the equivalents thereof.

The invention claimed is:

1. A method for driving a liquid crystal display assembly, said liquid crystal display assembly comprising a transmission-type liquid crystal display comprising a display area made up of pixels arrayed in a two-dimensional matrix form, a planar light source device to illuminate said display area from the back, and a driving circuit to drive said planar light source device and said liquid crystal display, wherein a control signal to control the optical transmittance of each of said pixels is supplied to each of said pixels from said driving circuit; said method comprising, for each frame with image display of said liquid crystal display, the acts of:

controlling the luminance of said planar light source device by said driving circuit such that, when assuming that said control signal equivalent to a driving signal having a value equivalent to an intra-frame driving signal maximum value $X_{F-max}$ which is the maximum value of the values of driving signals that are input to said driving circuit for driving all of said pixels making up said display area is supplied to a pixel, the luminance of said pixel is obtained; and controlling the luminance of said planar light source device by said driving circuit by adjusting the power said driving circuit provides to said planar light source device to at least three different levels during the frame based on the response speed of a liquid crystal material making up said pixels.

2. The method for driving a liquid crystal display assembly according to claim 1, wherein each of said pixels is configured with multiple sub pixels as a set each of which emits light having a different color;

and wherein said control signal for controlling the optical transmittance of each of said sub pixels is supplied from said driving circuit to each of said sub pixels making up each of said pixels.

3. The method for driving a liquid crystal display assembly according to claim 1, wherein a light source making up said planar light source device is made up of a light emitting diode driven based on pulse-width modulation; and wherein, when assuming that the number of the unit luminescence periods of said light emitting diode in one frame is K, a duty ratio in driving based on the pulse-width modulation of said light emitting diode during the k'th unit luminescence period (wherein k=1, 2, 3, and so on through K) is controlled, thereby controlling the luminance of said planar light source device based on the response speed of said liquid crystal material making up said pixels.

4. A method for driving a liquid crystal display assembly, said liquid crystal display assembly comprising a transmission-type liquid crystal display including a display area made up of pixels arrayed in a two-dimensional matrix form, which is subjected to line sequential driving, a planar light source device which is made up of, when assuming that said display area of said liquid crystal display are divided into P×Q virtual display area units, P×Q planar light source units corresponding to said P×Q display area units, with each of said planar light source units illuminating the display area unit corresponding thereto from the back, and a driving circuit to drive said planar light source device and said liquid crystal display, wherein a control signal to control the optical transmittance of each of said pixels is supplied to each of said pixels from said driving circuit, said method comprising, for each frame with image display of said liquid crystal display, the acts of:

controlling the luminance of said planar light source unit by said driving circuit such that, when assuming that said control signal equivalent to a driving signal having a value equivalent to an intra-frame driving signal maximum value $X_{F\text{-}max}$ which is the maximum value of the values of driving signals that are input to said driving circuit for driving all of said pixels making up said display area is supplied to a pixel, the luminance of said pixel is obtained;

controlling the luminance of said planar light source unit by said driving circuit by adjusting the power said driving circuit provides to said planar light source device to at least three different levels during the frame based on the response speed of a liquid crystal material making up said pixels; and controlling the light emitting start period of each of said planar light source units by said driving circuit depending on the disposed position of each of said planar light source units.

5. The method for driving a liquid crystal display assembly according to claim 4, wherein each of said pixels is configured with multiple sub pixels as a set each of which emits light having a different color; and wherein said control signal for controlling the optical transmittance of each of said sub pixels is supplied from said driving circuit to each of said sub pixels making up each of said pixels.

6. The method for driving a liquid crystal display assembly according to claim 4, wherein a light source making up said planar light source unit is made up of a light emitting diode driven based on pulse-width modulation; and wherein, when assuming that the number of the unit luminescence periods of said light emitting diode in one frame is K, a duty ratio in driving based on the pulse-width modulation of said light emitting diode during the k'th unit luminescence period (wherein k=1, 2, 3, and so on through K) is controlled, thereby controlling the luminance of said planar light source unit based on the response speed of said liquid crystal material making up said pixels.

7. A method for driving a liquid crystal display assembly, said liquid crystal display assembly comprising a transmission-type liquid crystal display comprising a display area made up of pixels arrayed in a two-dimensional matrix form, which is subjected to line sequential driving, a planar light source device which is made up of, when assuming that said display area of said liquid crystal display are divided into P×Q virtual display area units, P×Q planar light source units corresponding to said P×Q display area units, with each of said planar light source units illuminating the display area unit corresponding thereto from the back, and a driving circuit to drive said planar light source device and said liquid crystal display; wherein a control signal to control the optical transmittance of each of said pixels is supplied to each of said pixels from said driving circuit; and wherein, for each frame with image display of said liquid crystal display, said method comprises acts of:

controlling the luminance of said planar light source unit corresponding to said display unit by said driving circuit with each of said planar light source units such that, when assuming that said control signal equivalent to a driving signal having a value equivalent to an intra-display-area-unit driving signal maximum value $X_{u\text{-}max}$ which is the maximum value of the values of driving signals that are input to said driving circuit for driving all of said pixels making up said display area is supplied to a pixel, the luminance of said pixel is obtained, and controlling the luminance of said planar light source unit by said driving circuit by adjusting the power said driving circuit provides to said planar light source device to at least three different levels during the frame based on the response speed of a liquid crystal material making up said pixels.

8. The method for driving a liquid crystal display assembly according to claim 7, for each frame with image display of said liquid crystal display, further comprising an act of:

controlling the light emitting start period of each of said planar light source units by said driving circuit depending on the disposed position of each of said planar light source units.

9. The method for driving a liquid crystal display assembly according to claim 7, wherein each of said pixels is configured with multiple sub pixels as a set each of which emits light having a different color; and wherein said control signal for controlling the optical transmittance of each of said sub pixels is supplied from said driving circuit to each of said sub pixels making up each of said pixels.

10. The method for driving a liquid crystal display assembly according to claim 7, wherein a light source making up said planar light source unit is made up of a light emitting diode driven based on pulse-width modulation; and wherein, when assuming that the number of the unit luminescence periods of said light emitting diode in one frame is K, a duty ratio in driving based on the pulse-width modulation of said light emitting diode during the k'th unit luminescence period (wherein k=1, 2, 3, and so on through K) is controlled, thereby controlling the luminance of said planar light source unit based on the response speed of said liquid crystal material making up said pixels.

11. The method for driving a liquid crystal display assembly according to claim 10, wherein the value of K is an integer multiple of the value of Q.

* * * * *